US011408107B2

(12) United States Patent
Im et al.

(10) Patent No.: US 11,408,107 B2
(45) Date of Patent: Aug. 9, 2022

(54) METHOD FOR CONTROLLING WASHING MACHINE

(71) Applicant: LG Electronics Inc., Seoul (KR)

(72) Inventors: Myunghun Im, Seoul (KR); Hwanjin Jung, Seoul (KR); Jaehyun Kim, Seoul (KR); Junghoon Lee, Seoul (KR); Kyungchul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 36 days.

(21) Appl. No.: 16/235,708

(22) Filed: Dec. 28, 2018

(65) Prior Publication Data

US 2019/0203396 A1 Jul. 4, 2019

(30) Foreign Application Priority Data

Dec. 28, 2017 (KR) ..... 10-2017-0182264
Jan. 5, 2018 (KR) ..... 10-2018-0001840

(51) Int. Cl.
*D06F 33/32* (2020.01)
*D06F 39/08* (2006.01)
(Continued)

(52) U.S. Cl.
CPC ..... *D06F 33/32* (2020.02); *D06F 23/06* (2013.01); *D06F 39/085* (2013.01); *D06F 34/28* (2020.02);
(Continued)

(58) Field of Classification Search
CPC .... D06F 33/00–76; D06F 34/00; D06F 34/16; D06F 37/30; D06F 37/304–308;
(Continued)

(56) References Cited

U.S. PATENT DOCUMENTS 4,697,293 A * 10/1987 Knoop ..... D06F 39/087 8/158
5,237,256 A * 8/1993 Bashark ..... D06F 37/304 318/817
(Continued)

FOREIGN PATENT DOCUMENTS

EP 2169105 3/2010
EP 2471993 7/2012
(Continued)

OTHER PUBLICATIONS

Extended European Search Report in European Application No. 18215040.9, dated Apr. 26, 2019, 8 pages.
(Continued)

*Primary Examiner* — Michael E Barr
*Assistant Examiner* — Omair Chaudhri
(74) *Attorney, Agent, or Firm* — Fish & Richardson P.C.

(57) ABSTRACT

A method of controlling a washing machine that includes a tub, a drum rotatably disposed in the tub, at least one nozzle spraying water into the drum, a washing motor rotating the drum relative to the tub, and a circulation pump circulating water discharged from the tub, the method including: rotating the drum to cause laundry in the drum (i) to be raised with respect to a bottom of the drum and (ii) to fall downwards into the drum while water is supplied to the drum; spraying water through the at least one nozzle while the drum rotates; based on a first water level in the tub, controlling the circulation pump to rotate at a first rotation speed; supplying water to the drum to increase the water in the tub to a second water level; and controlling the circulation pump to rotate at a second rotation speed.

12 Claims, 16 Drawing Sheets

(51) Int. Cl.

| | |
|---|---|
| ***D06F 23/06*** | (2006.01) |
| ***D06F 103/18*** | (2020.01) |
| ***D06F 103/24*** | (2020.01) |
| ***D06F 105/02*** | (2020.01) |
| ***D06F 105/06*** | (2020.01) |
| ***D06F 34/28*** | (2020.01) |
| ***D06F 37/30*** | (2020.01) |
| *D06F 103/04* | (2020.01) |

(52) U.S. Cl.
CPC ..... *D06F 37/304* (2013.01); *D06F 2103/04* (2020.02); *D06F 2103/18* (2020.02); *D06F 2103/24* (2020.02); *D06F 2105/02* (2020.02); *D06F 2105/06* (2020.02)

(58) Field of Classification Search
CPC ..... D06F 39/083; D06F 39/085; D06F 2202/085; D06F 2103/18; D06F 2105/06; D06F 2204/065; D06F 2204/082; D06F 2204/086
See application file for complete search history.

(56) References Cited

U.S. PATENT DOCUMENTS

| | | | | |
|---|---|---|---|---|
| 2003/0097719 | A1* | 5/2003 | Choi | D06F 33/36 8/158 |
| 2003/0205246 | A1* | 11/2003 | Christman | A47L 15/4244 134/18 |
| 2005/0022564 | A1* | 2/2005 | Kim | D06F 34/18 68/12.04 |
| 2006/0010613 | A1* | 1/2006 | Jeon | D06F 35/006 8/158 |
| 2007/0118997 | A1* | 5/2007 | Choi | D06F 34/08 8/158 |
| 2012/0180534 | A1* | 7/2012 | Cho | D06F 35/006 68/18 R |
| 2013/0200834 | A1* | 8/2013 | Kim | D06F 35/005 318/445 |
| 2017/0096769 | A1 | 4/2017 | Kim et al. | |
| 2019/0323162 | A1* | 10/2019 | Jung | D06F 37/266 |

FOREIGN PATENT DOCUMENTS

| | | | | |
|---|---|---|---|---|
| EP | 2169105 | B1 * | 12/2013 | D06F 33/00 |
| EP | 2754743 | | 7/2014 | |
| EP | 2754743 | B1 * | 5/2016 | D06F 33/00 |
| EP | 2348151 | | 7/2017 | |
| EP | 2471993 | B1 * | 10/2019 | D06F 39/085 |
| JP | 2014212809 | | 11/2014 | |
| JP | 2014212809 | A * | 11/2014 | |
| KR | 20110029459 | | 3/2011 | |
| KR | 1020160044901 | | 4/2016 | |
| KR | 101651126 | | 9/2016 | |

OTHER PUBLICATIONS

PCT International Search Report in International Application No. PCT/KR2018/016867, dated May 1, 2019, 3 pages.
Office Action in Korean Appln. No. 10-2018-0001840, dated Jan. 21, 2022, 11 pages (with English translation).

* cited by examiner

METHOD FOR CONTROLLING WASHING MACHINE

CROSS-REFERENCE TO RELATED APPLICATIONS

This application claims the benefit of an earlier filing date and right of priority to Korean Patent Application Nos. 10-2017-0182264 filed on Dec. 28, 2017 and 10-2018-0001840 filed on Jan. 5, 2018 in the Korean Intellectual Property Office, the disclosures of which are herein incorporated by reference in their entirety.

TECHNICAL FIELD

The present invention relates to a method for controlling a washing machine having a circulation pump that circulates wash water.

BACKGROUND

Generally, a washing machine is a generic name for an apparatus that removes contaminants from clothing, bed sheets, etc. (hereinafter, referred to as "laundry") using chemical decomposition of detergent with water and a physical force such as friction between water and the laundry.

EP 2 754 743 A1 (hereinafter, referred to as "Related Art") discloses a washing machine including a circulating pump of which a rotation speed is variable. In Related Art, while water is additionally supplied for a rinsing process, the rotation speed of the circulation pump increases in phases. In response to an increase in the water level due to the additional water supply, the circulating pump is controlled to rotate at a high speed, thereby providing a sufficient amount of water to wash water.

In the Related Art, a drum is controlled to rotate at 100 r/min to 140 r/min during operation of the circulating pump, and, in this case, laundry in the drum rotates along with the drum while stuck on an inner circumferential surface of the drum. This method is a method of performing a rinsing process in a manner in which water sprayed through a circulation nozzle passes through laundry and then discharged to a tub through through-holes formed in the drum.

However, this method has a limitation when it comes to uniformly soaking laundry despite of an additional water supply and an increase in the speed of the circulating pump (an increase in the flow rate or the spray pressure) because the position of the laundry on the drum is fixed during the rinsing process and thus a water stream sprayed from the circulation nozzle reaches the same region of the laundry all the time.

SUMMARY

One object of the present invention is to provide a method for controlling a washing machine, the method which enables controlling a speed of a circulation pump according to a level of wash water in a drum and causes movement of laundry in the drum in this course, thereby causing circulating water sprayed from a nozzle to be uniformly applied to the laundry. In addition, another object of the present invention is to provide a method for controlling a washing machine, the method which keeps a level of water in the drum low upon a supply of detergent in an initial washing stage, thereby applying highly detergent concentrated wash water to laundry, and which has no option but rotating the circulation pump at a low speed due to the low water level, thereby causing the laundry in the drum to fall to a water surface repeatedly despite a small amount of water sprayed through a nozzle.

In addition, yet another object of the present invention is to provide a method for controlling a washing machine, the method in which laundry is treated with high detergent concentrated wash water upon a low water level and then the level of water in the drum is increased and a circulation pump is controlled to rotate at a higher speed, thereby increasing a flow rate of wash water to be sprayed from a nozzle to the laundry.

These objects are achieved with the features of the methods of the independent claims.

In one general aspect of the present invention, there is provided a method for controlling a washing machine having a tub for containing water, a drum rotatably provided in the tub, at least one nozzle for spraying water into the drum, a washing motor configured to rotate the drum, and a circulation pump configured to pump water discharged from the tub to the at least one nozzle.

The method includes controlling rotation of the drum and operation of the circulation pump such that the drum rotates to cause laundry in the drum to be lifted to a predetermined height and fall therefrom while the drum is filled with water, and that water is sprayed through the at least one nozzle while the drum rotates.

The controlling of the operation of the circulation pump while rotating the drum comprises: when a level of water in the drum corresponds to a first water level, controlling the circulation pump to rotate at a first rotation speed that is set in correspondence with the first water level; increasing the level of water in the drum to a second water level; and controlling the circulation pump to rotate at a second rotation speed that is set in correspondence with the second water level.

The second rotation speed may be higher than the first rotation speed.

The method may further include sensing an amount of the laundry in the drum, and the second water level may be set according to the amount of the laundry.

The controlling of the circulation pump to rotate at the second rotation speed is performed after the level of water in the drum reaches the second water level.

In the controlling of the operation of the circulation pump while rotating the drum, the drum may repeat rotating and stopping at a predetermined time interval while the circulation pump rotates.

In another general aspect of the present invention, there is provided a method for controlling a washing machine, the method including: controlling the washing motor such that laundry in a drum is lifted by a first angle in a rotation direction of the drum while stuck to an inner circumferential surface of the drum and falls therefrom, and controlling a circulation pump motor included in the circulation pump such that water is sprayed through the at least one nozzle, and, in the step (a), the circulation pump may be controlled to rotate at a rotation speed that is set in correspondence to a level of water in the drum. The step (a) may include: a step (a-1) of, when the level of water in the drum corresponds to a first water level, controlling the washing motor such that the drum rotates, and rotating the circulation pump motor at a first rotation speed; and a step (a-2) of, when the level of water in the drum corresponds to a second water level, controlling the washing motor such that the drum rotates, and rotating the circulation pump motor at a second rotation speed higher than the first rotation speed.

The method may further include a step (b) of sensing a load of the laundry in the drum, and, in the step (a-2), the second water level may be set according to the load of the laundry sensed in the step (b).

In the step (a), a rotation speed of the circulation pump motor increases by an amount of increase in speed that is set based on an amount of water supplied upon a water supply.

The washing machine may include a direct water nozzle for spraying water, supplied through a water supply valve, into the drum, and the step (a) may include a step of opening the water supply valve such that the water is supplied into the drum through the direct water nozzle.

The method for controlling a washing machine according to the present invention may enhance washing performance by using highly detergent concentrated wash water in an initial washing stage. That is, by increasing the level of water in the tub in phases, it is possible to remove contaminants from laundry using highly detergent concentrated was water and then, when the level of water in the tub rises, enhance washing performance using a water stream sprayed from a nozzle.

Effects of the present invention should not be limited to the aforementioned effects and other unmentioned effects will be clearly understood by those skilled in the art from the claims.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
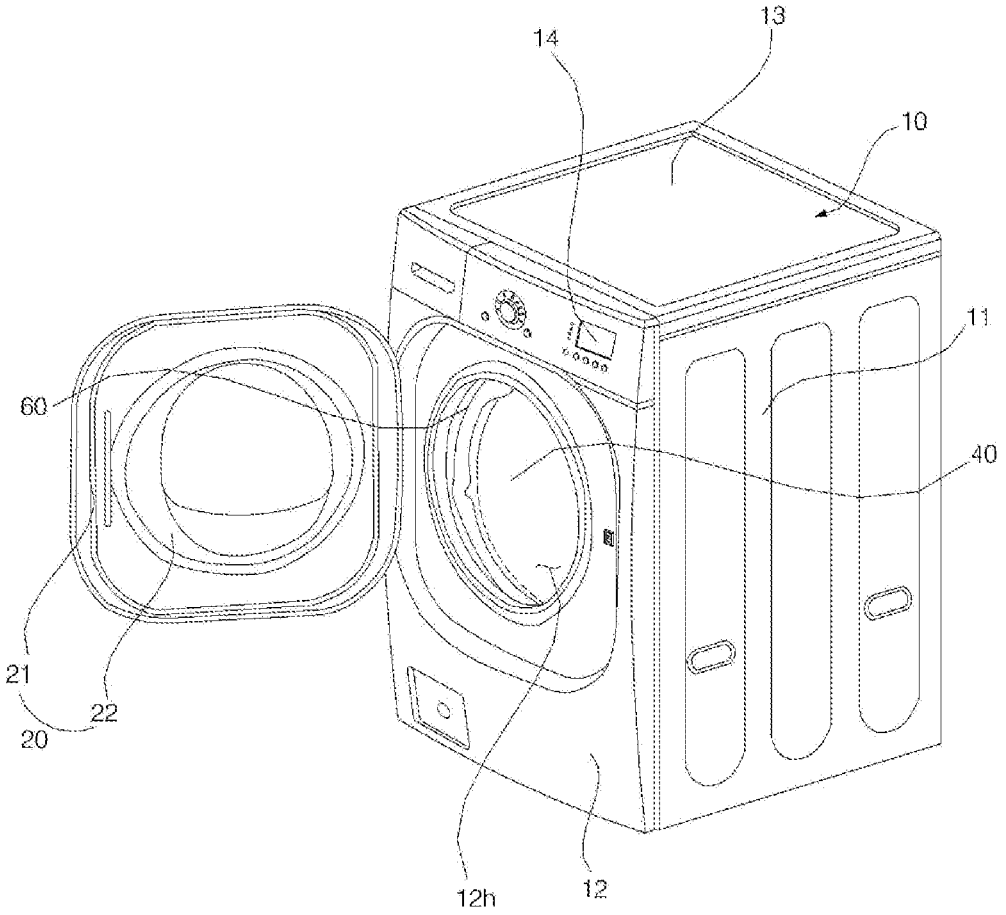
FIG. 1 is a perspective view illustrating a washing machine according to an embodiment of the present invention.
Figure 2:
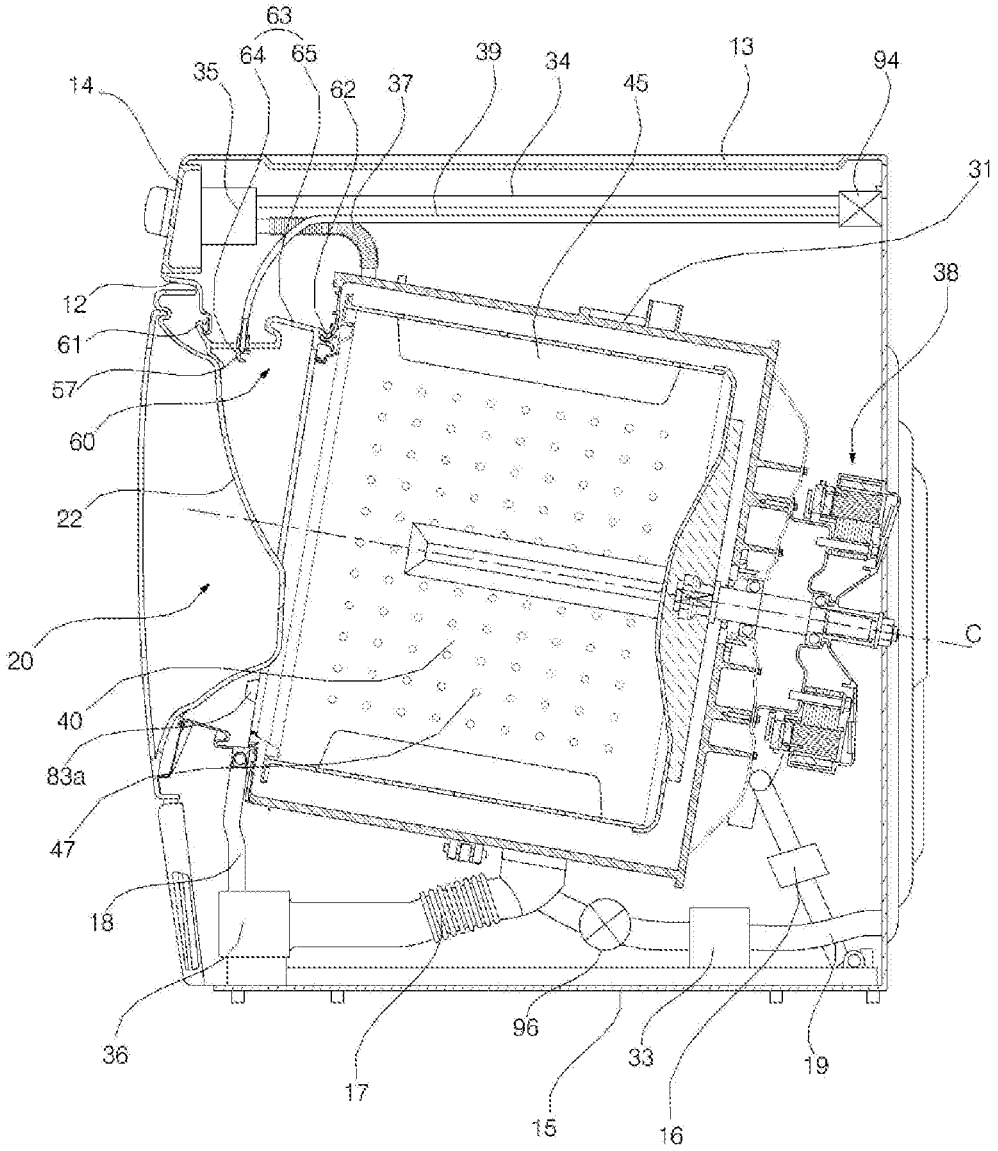
FIG. 2 is a cross-sectional view illustrating the washing machine illustrated in FIG. 1.
Figure 3:
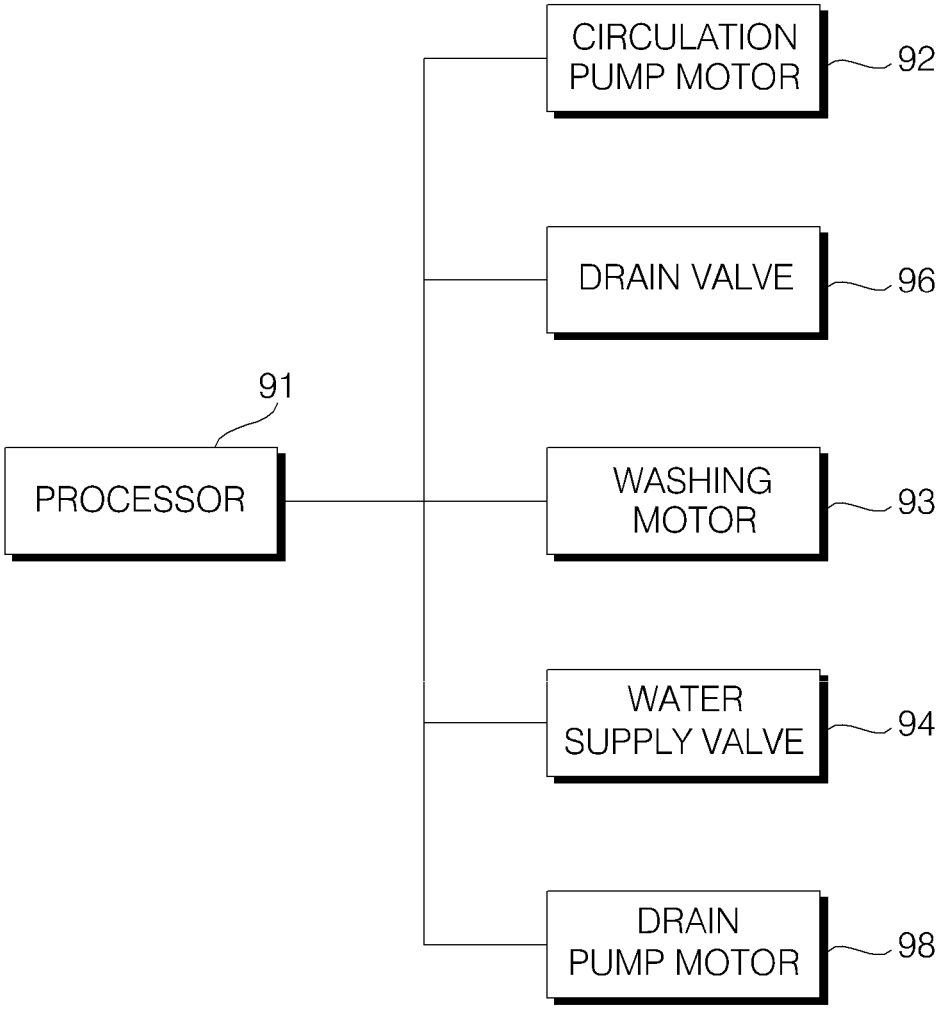
FIG. 3 is a block diagram illustrating a control relationship between major components of a washing machine according to an embodiment of the present invention.
Figure 4:
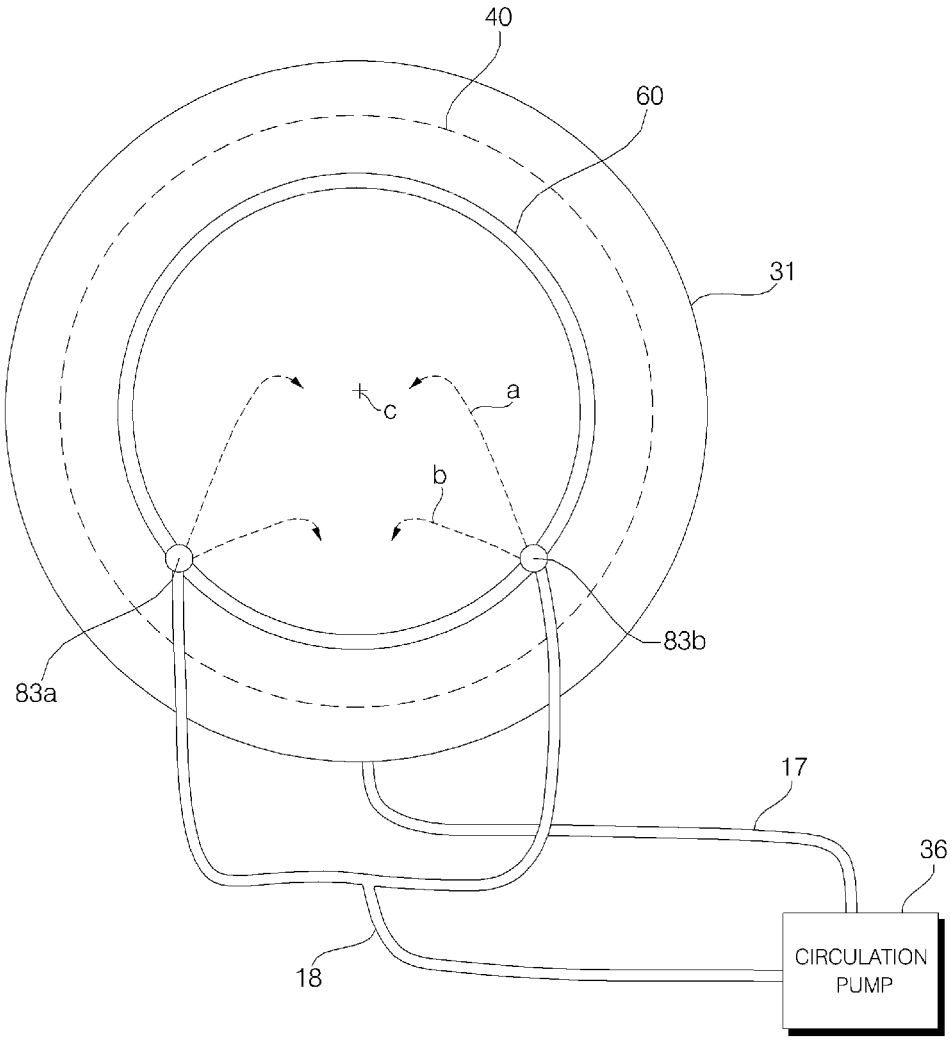
FIG. 4 is a diagram schematically illustrating major components of a washing machine according to an embodiment of the present invention.

FIG. 1 is a perspective view illustrating a washing machine according to an embodiment of the present invention. FIG. 2 is a cross-sectional view illustrating the washing machine illustrated in FIG. 1. FIG. 3 is a block diagram illustrating a control relationship between major components of a washing machine according to an embodiment of the present invention. FIG. 4 is a diagram schematically illustrating major components of a washing machine according to an embodiment of the present invention.

Referring to FIGS. 1 to 4, a casing 10 defines an exterior appearance of a washing machine, and an entry hole **12*h* through which laundry is loaded is formed on a front surface of the casing 10. The casing 10 may include: a cabinet 11 having an opened front surface, a left surface, right surface, and a rear surface; and a front panel 12 coupled to the opened front surface of the cabinet 11. The entry hole 12*h* may be formed on the front panel 12. The cabinet 11 may have an opened bottom surface and an opened top surface, and a horizontal base 15 for supporting the washing machine may be coupled to the bottom surface of the cabinet 11. The casing 10 may further include a top plate 13 covering the opened top surface of the cabinet 11, and a control panel 14 disposed in an upper side of the front panel 12**.

The control panel 14 may include an input unit (e.g., a button, a dial, a touch pad, etc.) for receiving various settings regarding operation of the washing machine from a user, and a display unit (e.g., an LCD, an LED display, etc.) for displaying an operation state of the washing machine.

A door 20 for opening and closing the entry hole **12*h* may be rotatably coupled to the casing 10. The door 20 may include: a door frame 21 having an opened portion, approximately at the center thereof, and rotatably coupled to the front panel 12; and a window 22 installed at the opened central portion of the door frame 21**.

A tub 31 for containing water may be disposed in the casing 10. An entrance hole is formed on a front surface of the tub 31 to receive laundry, and the entrance hole communicates with the entry hole **12*h* of the casing 10 by the gasket 60**.

The gasket 60 serves to prevent leakage of water contained in the tub 31. A front end of the gasket 60 is coupled to the front surface (or the front panel 12) of the casing 10, a rear end of the gasket 60 is coupled to the entrance hole of the tub 31, and a portion between the front end and the rear end extends in a tube shape. The gasket 60 may be formed of a flexible or elastic material. The gasket 60 may be formed of rubber or synthetic resin.

The gasket 60 may include: a casing coupler 61 coupled to a circumference of the entry hole **12*h* of the casing 10; a tub coupler 62 coupled to a circumference of the entrance hole of the tub 31; and a tube-shaped extension part 63 extending from the casing coupler 61 to the tub coupler 62**.

The extension part 63 may include: a flat portion 64 evenly extending from the casing coupler 61 toward the tub coupler 62; and a foldable portion 65 formed between the flat portion 64 and the tub coupler 62.

The foldable portion 65 is folded or unfolded when the tub 31 moves in an eccentric direction. The foldable portion 65 may be formed at a part of the circumference of the gasket 60 or formed over the entire circumference of gasket 60.

At least one nozzle 83*a* or 83*b* may be installed in the gasket 60. The at least one nozzle 83*a* or 83*b* is preferably installed in the flat portion 64. According to an embodiment, the at least one nozzle 83*a* or 83*b* may be integrally formed with the flat portion 64, but aspects of the present invention are not limited thereto and a nozzle connection structure (not shown) may be formed in the flat portion 64 such that a nozzle inlet pipe (not shown, a pipe through which water pumped by a circulation pump 36 is introduced) formed separately from the gasket 60 is inserted/fixed to the nozzle connection structure. In either case, it is preferable that an outlet of the at least one nozzle 83*a* or 83*b* for injecting water toward a drum 40 is positioned in an inner area surrounded by the gasket 60, and that a circulating water guide pipe 18 is connected to the inlet pipe in the outside of the gasket 60.

A circumference of the entrance hole of the front panel 12 is rolled outward, and the casing coupler 61 is fitted into a concave portion formed by a circumference of the rolled portion. A ring-shaped groove to be wound by a wire is formed in the casing coupler 61, and the wire is wound around the groove and then both ends of the wire are jointed such that the casing coupler 61 is rigidly fixed to the circumference of the entrance hole of the front panel 12.

The drum 40 in which laundry is accommodated is rotatably provided in the tub 31. A plurality of through holes 47 communicating with the tub 31 may be formed in the drum 40. In addition, a lifter 45 for lifting laundry upon rotation of the drum 40 may be provided on an inner circumferential surface of the drum 40.

The drum 40 is disposed such that the entry hole, through which laundry is loaded, is positioned on the front surface, and the drum 40 rotates around a rotation central line C which is approximately horizontal. In this case, "horizontal" does not refer to the a mathematical definition thereof. That is, even in the case where the rotation central line C is inclined at a predetermined angle relative to a horizontal state, the rotation central line C may be considered approximately horizontal if the rotation central line C is more like in the horizontal state than in a vertical state.

The tub 31 may be supported by a damper 16 installed at the bottom of the casing 10. Vibration of the tub 31 caused by rotation of the drum 40 may be annulated by the damper 16.

There may be provided a water supply hose (not shown) for guiding water supplied from an external water source, such as a water tap, to the tub 31, and a water supply valve 94 for regulating the water supply hose.

A dispenser 35 for providing additives such as detergent and textile softener to the drum 40 may be provided. Additives may be accommodated separately in the dispenser 35 according to types thereof. The dispenser 35 may include a detergent accommodator (not illustrated) for accommodating detergent, and a softener accommodator (not illustrated) for accommodating textile softener.

At least one water supply pipe 34 may be provided to selectively guide water, supplied through a water supply valve 94, to each accommodator of the dispenser 35. The at least one water supply pipe 34 may include a first water supply pipe for supplying water to the detergent accommodator, and a second water supply pipe for supplying water to the textile softener accommodator, and, in this case, the water supply valve 94 may include a first water supply valve for regulating the first water supply pipe, and a second water supply valve 2 for regulating the second water supply pipe.

Meanwhile, the gasket 60 may include a direct water nozzle for injecting water into the drum 40, and a direct water supply pipe 39 for guiding water, supplied through the water supply valve 94, to the direct water nozzle 57. The water supply valve 94 may include a third water supply valve for regulating the direct water supply pipe 39.

Water discharged from the dispenser 35 is supplied to the tub 31 through a water supply bellows 37. A water supply hole (not illustrated) connected to the water supply bellows 37 may be formed in the tub 31. A drain hole for discharging water may be formed in the tub 31, and a drain bellows 17 may be connected to the drain hole. There may be a circulation pump 36 for pumping water, discharged from the drain bellows 17, to the circulating water guide pipe 18.

The circulation pump 36 may include: an impeller (not illustrated) for pumping water; a pump housing (not shown) for housing the impeller; and a circulation pump motor 92 for rotating the impeller. The pump housing may include: an inlet port (not shown) through which water is introduced from the drain bellows 17; and a circulating water discharge port (not shown) which discharges water, pumped by the impeller, to the circulating water guide pipe 18. An entrance hole of the circulating water guide pipe 18 is connected to the circulating water discharge port, and an exit hole thereof is connected to the at least one nozzle 83*a* or 83*b* which will be described later.

If a user inputs a setting (e.g., washing course, washing time, rinsing time, spin-drying time, spin-drying speed, etc.) through the input unit provided on the control panel 14, a controller or a processor 91 controls the washing machine to operate according to the input setting. For example, an algorithm of the water supply valve 94, a washing motor 93, the circulation pump motor 92, a discharge valve 96, and the like according to each course selectable through the input unit may be stored in a memory (not shown), and the processor 91 may perform control such that the washing machine operates according to an algorithm corresponding to a setting input through the input unit.

There may be provided a drain pump 33 for pumping water, discharged from the pump 31, to a drain pipe 19. The drain pump 33 pumps water, introduced through the discharge bellows 17, to the drain pipe 19. The drain pump 33 may include: an impeller (not illustrated) for pumping water; a pump housing (not illustrated) for accommodating the impeller; and a drain pump motor 98 for rotating the impeller. The drain pump motor 98 may be configured substantially identical to the circulation pump motor 92. The pump housing may include: an inlet port (not illustrated) in which water is introduced through the discharge bellows 17; and a discharge port (not illustrated) which discharges water, pumped by the impeller, to the drain pipe 19.

Under control of the processor 91, according to a preset algorithm, the circulation pump 38 (for example, when washing laundry) or the drain pump 33 (for example, when draining water) may operate.

Meanwhile, the circulation pump motor 92 is a variable speed motor whose rotation speed is controllable. The circulation pump motor 92 may be a Brushless Direct Current Motor (BLDC), but aspects of the present invention are not limited thereto. There may be further provided a driver for controlling a speed of the circulation pump motor 92, and the driver may be an inverter driver. The inverter driver inputs a target frequency to the motor by converting AC power into DC power.

The circulation pump motor 92 may be controlled by the processor 91. The processor 91 may include a Proportional-Integral (PI) controller, a Proportional-Integral-Derivative (PID) controller, and the like. The controller may receive an output value (e.g., an output current) of the circulation pump motor 92, and control an output value of the driver so that a rotation speed (or, the number of times of rotation) of the circulation pump motor 92 follows a preset target rotation speed (or, the number of times of rotation) based on the received output value of the circulation pump motor 92.

Meanwhile, the processor 91 may control not just the circulation pump motor 92, but also the drain pump motor 98, and may further control overall operations of the washing machine, and, although not explicitly mentioned, it is understood that each component described hereinafter is controlled by the processor 91.

There may be provided at least one nozzle 83*a* and 83*b* for spraying circulating water, pumped by the circulation pump 36, into the drum 40. In the embodiment, nozzles 83*a* and 83*b* disposed on both the left side and the right side of the gasket 60 under the center C of the drum 40 jet water in an upward direction, but aspects of the present invention are not necessarily limited thereto. That is, the number of nozzles and the positions thereof may vary, but, in any case, the washing machine according to an embodiment of the present invention preferably include at least one nozzle 83*a* or 83*b* that jets water further upward as the pressure of supplied water increases (that is, as discharge pressure, a discharge flow rate, a rotation speed, or the number of times of rotation of the circulation pump 36 increases).

An exit hole of each nozzle 83*a* or 83*b* may be opened upward in a direction inward the drum 40. Thus, when water of predetermined pressure or greater is supplied, water sprayed through each nozzle 83*a* or 83*b* may be in an upward inclined direction toward the inside of the drum 40 such that the jetted water reaches a region deep inside the drum 40.

Meanwhile, when pressure of water supplied to each nozzle 83*a* or 83*b* is not sufficient, water sprayed through the exit hole of each nozzle 83*a* or 83*b* is not allowed to be jetted upward enough and easily falls by gravity, ended up with failing to reach a region deep inside the drum 40.

In FIG. 4, a form of injecting water supplied by the circulation pump 36 with sufficient pressure is indicated by "a", and a form of injecting water with pressure lower than the sufficient pressure is indicated by "b". That is, as a rotation speed of the circulation pump 36 varies, the form of a water stream injected through each nozzle 83*a* or 83*b* may vary between a (high-speed rotation) and b (low-speed rotation).

Figure 5:
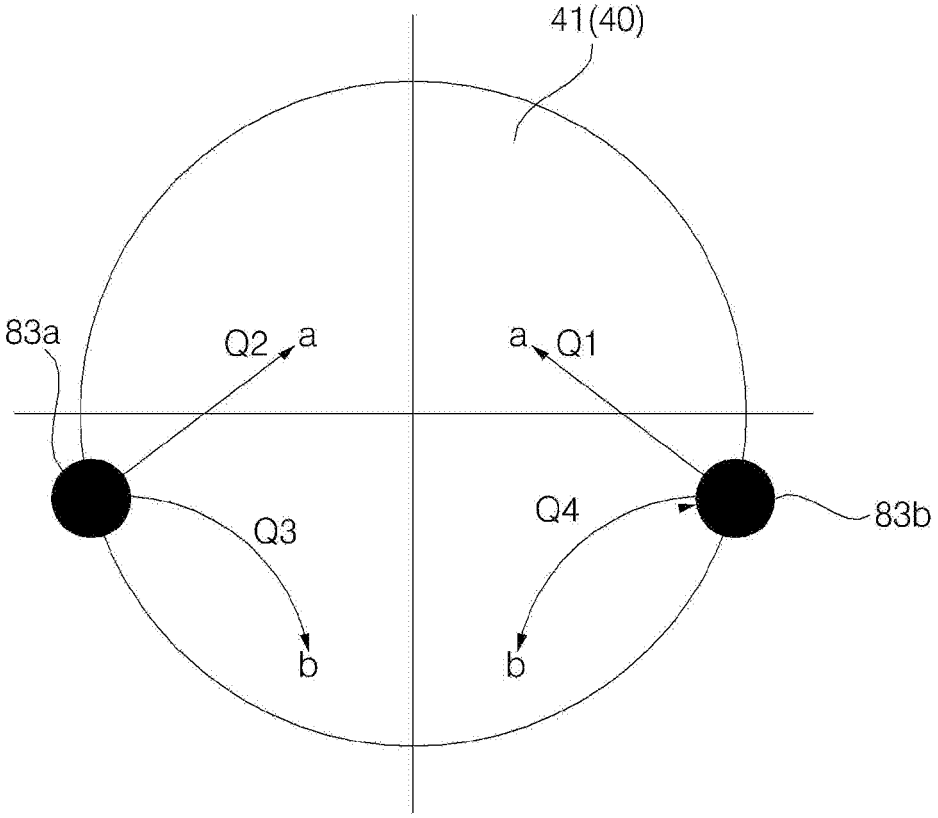
FIG. 5 schematically illustrates a front view of a drum, in which a jet span of each nozzle is illustrated.
Figure 6:
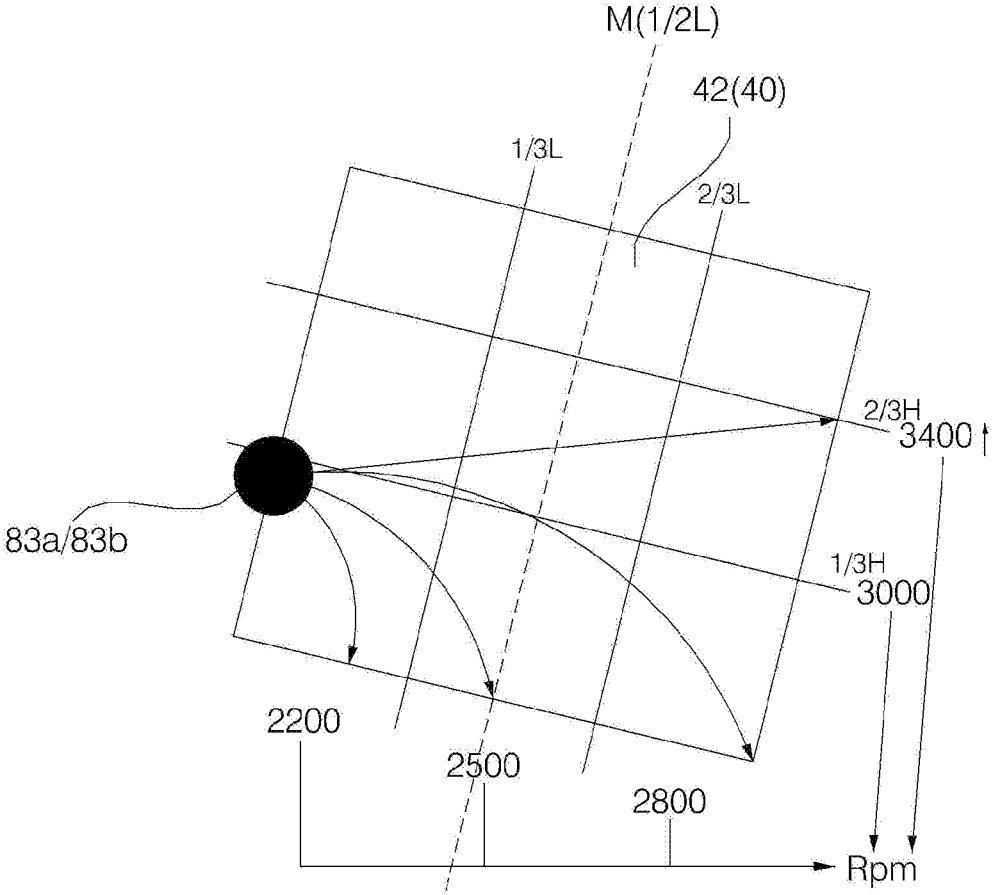
FIG. 6 schematically illustrates a side view of a drum, in which a jet span of each nozzle is illustrated.

FIG. 5 schematically illustrates a front view of a drum, in which a jet span of each nozzle is illustrated. FIG. 6 schematically illustrates a side view of a drum, in which a jet span of each nozzle is illustrated.

Referring to FIG. 5, quadrants Q1, Q2, Q3, and Q4 are defined by dividing the drum 40 into four, when viewed from a front side of the drum. A first nozzle 83*a* is disposed in a third quadrant Q3, and a second nozzle 83*b* is disposed in a fourth quadrant Q4. In FIG. 5, a lower limit b of a water stream sprayed through each of the nozzles 83*a* and 83*b* represents the case where the circulation pump motor 92 rotates at 2600 rpm, and an upper limit a of water sprayed through each of the nozzles 83*a* and 83*b* represents the case where the circulation pump motor 92 rotates at 3000 rpm.

The first nozzle 83*a* serves to jet water into a region ranging from the third quadrant Q3 and to the second quadrant Q2 according to a rotation speed of the circulation pump motor 92. That is, as a rotation speed of the circulation pump motor 92 increases, water is jetted gradually further upward through the first nozzle 83*a*, and, if the circulation pump motor 92 rotates at the highest speed, a water stream sprayed from the first nozzle 83*a* reaches up to the second quadrant Q2 of a rear surface 41 of the drum 40.

The second nozzle 83*b* serves to jet water into a region ranging the fourth quadrant Q4 and the first quadrant Q2 according to a rotation speed of the circulation pump motor 92. That is, as a rotation speed of the circulation pump motor 92 increases, water is jetted gradually further upward through the second nozzle 83*b*, and, if the circulation pump motor 92 rotates at the highest speed, a water stream sprayed from the second nozzle 83*b* reaches up to the first quadrant Q2 on the rear surface 41 of the drum 40.

Referring to FIG. 6, a first region, a second region, and a third region are defined as three divided regions of the drum 400, when viewed from a lateral side of the drum. As a rotation speed of the circulation pump motor 92 increases gradually, a water stream sprayed from at least one nozzle 83*a* or 83*b* reaches a region deeper inside the drum 40. As illustrates in the example of the drawing, if the rotation speed of the circulation pump motor 92 is 2200 rpm, a water stream sprayed from the at least one nozzle 83*a* or 83*b* reaches a first region (0~⅓ L) on an inner circumferential surface 42 of the drum 40; if the rotation speed of the circulation pump motor 92 is 2500 rpm, the water stream sprayed from the at least one nozzle 83*a* or 83*b* reaches a second region (⅓L~⅔L); if the rotation speed of the circulation pump motor 92 is 2800 rpm, the water stream sprayed from the at least one nozzle 83*a* or 83*b* reaches a third region (⅔L~L). If the rotation speed of the circulation pump motor 92 increases further, the water stream may reach the rear surface 41 of the drum 40. If the rotation speed is 300 rpm, the water stream reaches one third of the height H of the drum 40; if the rotation speed is 3400 rpm, the water stream reaches two third of the height H of the drum 40; and if the rotation speed is 3400 rpm, the water stream reaches the available maximum height, and the water stream is not allowed to reach further upward of the available maximum height due to the structure of the at least one nozzle 83*a* or 83*b*, ended up with increasing only intensity of the water stream.

Figure 7:
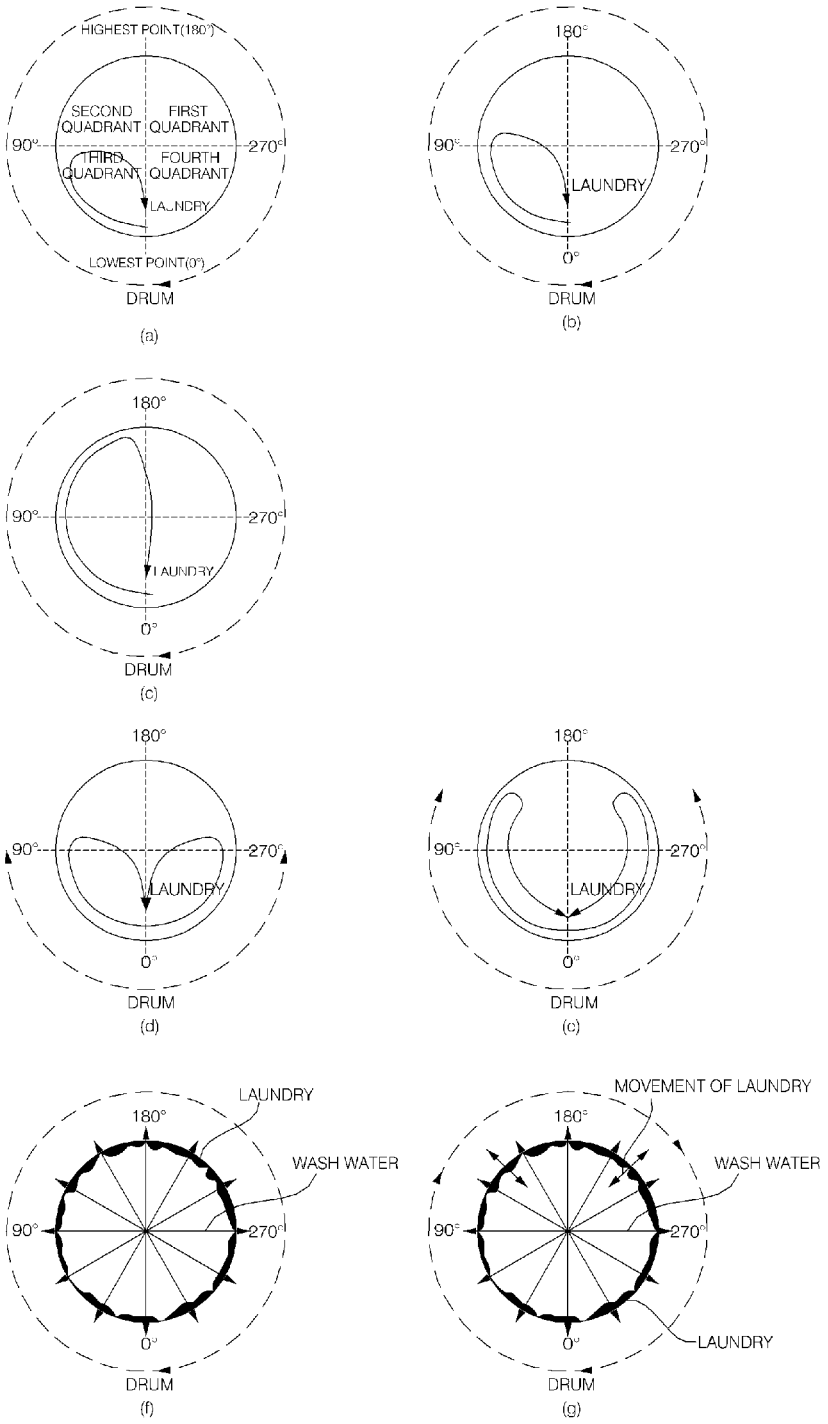
FIG. 7 is a diagram illustrating drum driving motions implementable by a washing machine according to an embodiment of the present invention.

FIG. 7 is a diagram illustrating drum driving motions implementable by a washing machine according to an embodiment of the present invention. Hereinafter, the drum driving motions will be described in detail with reference to FIG. 7.

A drum driving motion refers to a combination of a rotation direction and a rotation speed of the drum 40. A falling direction and a falling time of laundry accommodated in the drum may change According to a drum driving motion, and accordingly movement of the laundry in the drum 40 may change. The drum driving motion may be implemented as a washing motor 93 is controlled by the processor 91.

Since the laundry is lifted by the lifter 45 provided on the inner circumferential surface of the drum 40 upon rotation of the drum 40, an impact to be applied to the laundry may be varied by controlling a rotation speed and a rotation direction of the drum 40. That is, a mechanical force such as a frictional force between laundry items, a frictional force between laundry and wash water, and a falling impact on the laundry may be changed. In other words, an extent of pounding or rubbing the laundry for washing may be varied, and an extent of dispersing or turning upside down of the laundry may be varied.

In the meantime, in order to implement these various drum motions, it is preferable that the washing motor 93 is a direct drive motor. That is, a configuration of the motor is preferable in which a stator of the motor is fixedly secured to a rear of the tub 31, and a driving shaft 38 rotating along with a rotor of the motor directly drives the drum 40. It is because the direct drive motor facilitates control the rotation direction and torque of the motor so that the drum driving motion may be controlled promptly without a time lag or a backlash.

However, if the washing machine has a configuration in which a torque from the motor is transmitted to the driving shaft through a pulley and the like, it is allowed to implement a drum driving motion such as a tumbling motion and a spinning motion, which does not matter with the time lag or the backlash, but this configuration is not appropriate to implement other various drum driving motions. A method for driving the washing motor 93 and the drum 40 is obvious for those skilled in the art, and thus detailed description thereof is herein omitted.

In FIG. 7, (a) is a diagram illustrating a rolling motion. The rolling motion is a motion in which the washing motor 93 rotates the drum 40 in one direction (preferably one or more times of rotation) and makes laundry on the inner circumferential surface of the drum 40 to fall from a point at an angle less than 90 degrees in the rotation direction of the drum 40. In this case, the laundry falls to a lowest point in the drum 40.

For example, if the washing motor 93 rotates the drum 40 at about 40 rpm, laundry at the lowest point in the drum 40 is lifted to a predetermined height in the rotation direction of the drum 40 and falls to the lowest point in the drum 40 from a predetermined point at less than 90 degrees from the lowest point in the drum 40 in the rotation direction as if the laundry rolls. It appears that the laundry keeps rolling at the third quadrant 3Q of the drum 40 when the drum 40 rotates in a clockwise direction.

In the rolling motion, the laundry is washed by friction with the wash water, friction between the laundry, and friction with the inner circumferential surface of the drum 40. In this case, the motion causes an adequate turning upside down of the laundry, thereby providing an effect of softly rubbing the laundry.

Here, it is preferable that a rotation speed rpm of the drum 40 is determined in relation to a radius of the drum 40. That is, the greater the RPM of the drum 40, the stronger the centrifugal force on the laundry in the drum 40. A difference between the centrifugal force and the gravity makes movement of the laundry different. Of course, the rotation force of the drum 40 and the friction between the drum 40 and the laundry, and the RPM of the drum 40 should be taken into consideration as well. A rotation speed of the drum 40 in the rolling motion is determined such that a sum of various forces, such as a frictional force and a centrifugal force, applied to laundry is weaker than gravity 1G.

In FIG. 7, (b) is a diagram illustrating a tumbling motion. The tumbling motion is a motion in which the washing motor 93 rotates the drum 40 in one direction (preferably, one or more times of rotation) and makes the laundry on the inner circumferential surface of the drum 40 to fall from a point at about 90 to 110 degrees in the rotation direction of the drum 40 to the lowest point in the drum 40. The tumbling motion is a motion generally used in washing and rinsing since a mechanical force is generated only when the drum 40 is controlled to rotate in one direction at a proper rotation speed.

Laundry loaded into the drum 40 is positioned at the lowest point in the drum 40 before the motor 140 is driven. When the washing motor 93 provides a torque to the drum 40, the drum 40 rotates, making the lifter 45 provided on the inner circumferential surface of the drum 40 to lift the laundry from the lowest point in the drum 40. For example, if the washing motor 93 rotates the drum 40 at about 46 rpm, the laundry falls from a point at about 90 to 110 degrees in the rotation direction from the lower point of the drum 40.

In the tumbling motion, the rotation speed of the drum 40 may be determined such that the tumbling motion generates the centrifugal force stronger than the centrifugal force of the rolling motion but weaker than the gravity.

The tumbling motion appears such that the laundry is lifted from the lowest point in the drum 40 to a point at 90 degrees from the lowest point or up to the second quadrant Q2, and falls therefrom as separating away from the inner circumferential surface of the drum 40.

Accordingly, in the tumbling motion, the laundry is washed by friction of the laundry with the wash water and an impact caused by falling of the laundry, and especially by a mechanical force stronger than the mechanical force occurring in the rolling motion. In particular, the tumbling motion has an effect of disentangling and dispersing the laundry.

In FIG. 7, (c) is a diagram illustrating a step motion. The step motion is a motion in which the motor 140 rotates the drum 40 in one direction (preferably, complete one time of rotation) and makes the laundry on the inner circumferential surface of the drum 40 to fall from a highest point of the drum (preferably, a point at about 146 to 161 degrees from the lowest point in the drum 40, but not limited thereto, or a point at which the drum 40 is rotated greater than 161 degrees but smaller than 180 degrees (for example, a point rotated 180 degrees)).

That is, the step motion is a motion in which the drum 40 rotates at a speed at which the laundry is prevented from falling from the inner circumferential surface of the drum 40 owing to the centrifugal force (that is, a speed at which the laundry rotates along with the drum 40 while stuck to the inner circumference surface of the drum 40 owing to the centrifugal force), and the dram 40 is suddenly braked, thereby maximizing an impact on the laundry.

For example, if the washing motor 93 rotates the drum 40 at a speed over about 60 rpm, the laundry may rotate without falling owing to the centrifugal force (that is, rotating along with the drum 40 while stuck to the inner circumferential surface of the drum 40), and, in this course, if the laundry is lifted by the rotation of the drum 40 to reach a predetermined height, a torque of a direction opposite to the rotation direction of the drum 40 may be controlled to be applied to the washing motor 93.

In the step motion, compared to other motions, laundry is lifted to the highest point from the lowest point in the drum 40 by rotation of the drum 40 and then suddenly falls due to braking of the drum 40, maximizing a falling impact on the laundry. Therefore, a mechanical force (for example, an impact force) generated by the step motion is generally stronger than the mechanical force generated by the rolling motion or the tumbling motion.

The step motion appears such that, when the drum 40 rotates in a clockwise direction, the laundry moves to a predetermined height (for example, the highest point (180 degrees) of the drum 40) from the lowest point in the drum 40 via the third quadrant 3Q and the second quadrant 2Q, and is then suddenly separated from the inner circumferential surface of the drum 40, falling to the lowest point in the drum 40. Thus, the step motion provides a mechanical force to the laundry more effectively as an amount of the laundry is smaller.

In the meantime, reversing-phase braking is preferable for the motor 140 to brake the drum 40 in the step motion. The reversing-phase braking is a motor braking method in which a rotation force in a direction opposite to the current rotation direction of the washing motor 93 is generated to brake the washing motor 93. In order to generate the rotation force in a direction opposite to the current rotation direction of the washing motor 93, a phase of the current being supplied to the washing motor 93 may be inverted and accordingly the sudden braking is made in this manner.

The step motion is a motion in which the laundry is washed by friction between the drum 40 and the laundry while the drum rotates, and by the impact of falling of the laundry and turning the laundry upside down when the drum 40 is braked.

In FIG. 7, (d) is a diagram illustrating a swing motion. The swing motion is a motion in which the washing motor 93 rotates the drum 40 bidirectionally, and makes the laundry to fall from a point about less than 90 degrees (preferably, a point rotated about 30 to 45 degrees in the rotation direction of the drum 40, but not limited thereto, and possibly a point rotated greater than 45 degrees and smaller than 90 degrees) in the rotation direction of the drum 40. For example, if the washing motor 93 rotates the drum 40 in the counter-clockwise direction at about 40 rpm, the laundry at the lowest point in the drum 40 is lifted to a predetermined height in the counter-clockwise direction. In this case, the washing motor 93 stops the rotation of the drum 40 before the laundry reaches about a point rotated about 90 degrees in the counter-clockwise direction such that the laundry falls to the lowest point in the drum 40 from a point about less than 90 degrees in the counter-clockwise direction.

After the rotation of the drum 40 is stopped, the washing motor 93 rotates the drum 40 in a clockwise direction at about 40 rpm, lifting the laundry to a predetermined height along the rotation direction of the drum 40 (that is, a clockwise direction). Then, the washing motor 93 is controlled to stop rotating the drum 40 before the laundry reaches about a 90-degree point in the clockwise direction, making the laundry fall or roll down to the lowest point in the drum 40 from a point at about less than 90 degrees in the clockwise direction.

That is, the swing motion is a motion in which forward rotation and stopping of the drum 40 and backward rotation and stopping of the drum 40 are repeated, and it appears that the laundry repeats a motion in which the laundry is lifted from the lowest point to the second quadrant 2Q of the drum 40 via the third quadrant 3Q and falls therefrom softly, and then, the laundry is lifted to the first quadrant 1Q via the fourth quadrant 4Q of the drum 40 and falls therefrom softly. That is, the swing motion appears such that the laundry makes a motion which looks like a laid down character 8 over the third quadrant 3Q and the fourth quadrant Q4 of the drum 40.

In this case, rheostatic braking is adequate to brake the washing motor 93. The rheostatic braking may minimize a load on the washing motor 93 and mechanical wear of the washing motor, and control an impact being applied to the laundry.

The rheostatic braking is a braking method which uses a generator like action of the washing motor 93 owing to rotation inertia thereof when a current to the motor is turned off. If the current to the motor is turned off, a direction of the current to the coil of the washing motor 93 becomes opposite to a direction of the current before the power is turned off, and thus, a force (Fleming's right hand rule) acts in a direction which interferes the rotation of the washing motor 93, thereby braking the washing motor 93. Unlike the reversing-phase braking, the rheostatic braking does not make sudden braking of the washing motor 93, but makes a smooth change of the rotation direction of the drum 40.

In FIG. 7, (e) is a diagram illustrating a scrub motion. The scrub motion is a motion in which the washing motor 93 rotates the drum 40 bidirectionally and makes the laundry fall from beyond about 90 degrees in the rotation direction of the drum 40.

For example, if the washing motor 93 rotates the drum 40 in a forward direction at a speed of about 60 rpm or higher, the laundry is lifted from the lowest point in the drum 40 to a predetermined height in the forward direction. In this case, when the laundry reaches a point corresponding to a set angle of about 90 degrees or more (preferably, an angle of 139 to 150 degree, but not limited thereto, and possibly an angle of 150 degrees or more) in the forward direction, the washing motor 93 provides a reverse torque to the drum 40, thereby stopping the rotation of the drum 40 temporarily. Then, the laundry stuck to the inner circumferential surface of the drum 40 falls suddenly.

Then, the washing motor 93 rotates the drum 40 at a speed of about 60 RPM or more in the backward direction, thereby lifting the fallen laundry to a predetermined height of 90 degrees or more in the backward direction. When the laundry reaches a point corresponding to the set angle of 90 degrees or more (for example, an angle of 139 to 150 degrees) in the backward direction, the washing motor 93 provides a reverse torque to the drum 40 again, thereby stopping the rotation of the drum 40 temporarily. In this case, the laundry stuck to the inner circumferential surface of the drum 40 falls from a point of 90 degrees or more in the backward direction.

The scrub motion enables washing the laundry by making the laundry fall suddenly from a predetermined height. In this case, it is preferable that the washing motor 93 is reverse-phrase braked so as to brake the drum 40.

Since the rotation direction of the drum 40 is suddenly changed, the laundry is not separated away from the inner circumferential surface of the drum 40 to a great extent, and thus, the scrub motion may have a powerful rubbing effect of washing.

For example, the scrub motion is a repetitive motion in which the laundry moves to the second quadrant via the third quadrant, falls therefrom suddenly, moves to the first quadrant via the fourth quadrant, and falls therefrom suddenly. Therefore, the scrub motion appears that the laundry repeatedly moves up and down.

In FIG. 7, (f) is a diagram illustrating a filtration motion. The filtration motion is a motion in which the washing motor 93 rotates the drum 40 with preventing the laundry from being separated from the inside circumferential surface of the drum 40, while the wash water is sprayed through the at least one nozzle 83*a* or 83*b* to the inside of the drum 40.

Since the wash water is jetted to the inside of the drum 40 while the laundry is dispersed and rotates in close contact with the inner circumferential surface of the drum 40, the wash water penetrates the laundry owing to the centrifugal force and is then discharged to the tub 31 through the through holes 47 of the drum 40.

Since the filtration motion makes the wash water to penetrate the laundry while enlarging a surface area of the laundry, the laundry is uniformly soaked.

In FIG. 7, (g) is a diagram illustrating a squeeze motion. The squeeze motion is a motion in which the washing motor 93 repeats an operation of rotating the drum 40 such that the laundry does not fall from the inner circumferential surface of the drum 40 and reducing the rotation speed of the drum 40 such that the laundry is separated from the inner circumferential surface of the drum 40, while the wash water is jetted into the drum 40 through the at least one nozzle 83*a* or 83*b* during the rotation of the drum 40.

That is, the squeeze motion is different from the filtration motion in that, while, in the filtration motion, the laundry is rotated at a speed at which the laundry is not separated away from the inner circumferential surface of the drum 40, in the squeeze motion, the drum 40 repeats acceleration and deceleration of the drum such that laundry repeats being stuck to and separated from the inner circumferential surface.

In addition, the filtration motion causes the position of the laundry to be fixed with respect to the drum 40, whereas the squeeze motion causes the laundry to be repeatedly stuck to and separated from the drum, thereby bringing an effect of squeezing the laundry.

In addition, unlike the filtration motion, the squeeze motion causes a part of laundry to be stuck to and separated from the drum, thereby mixing laundry items.

Figure 8:
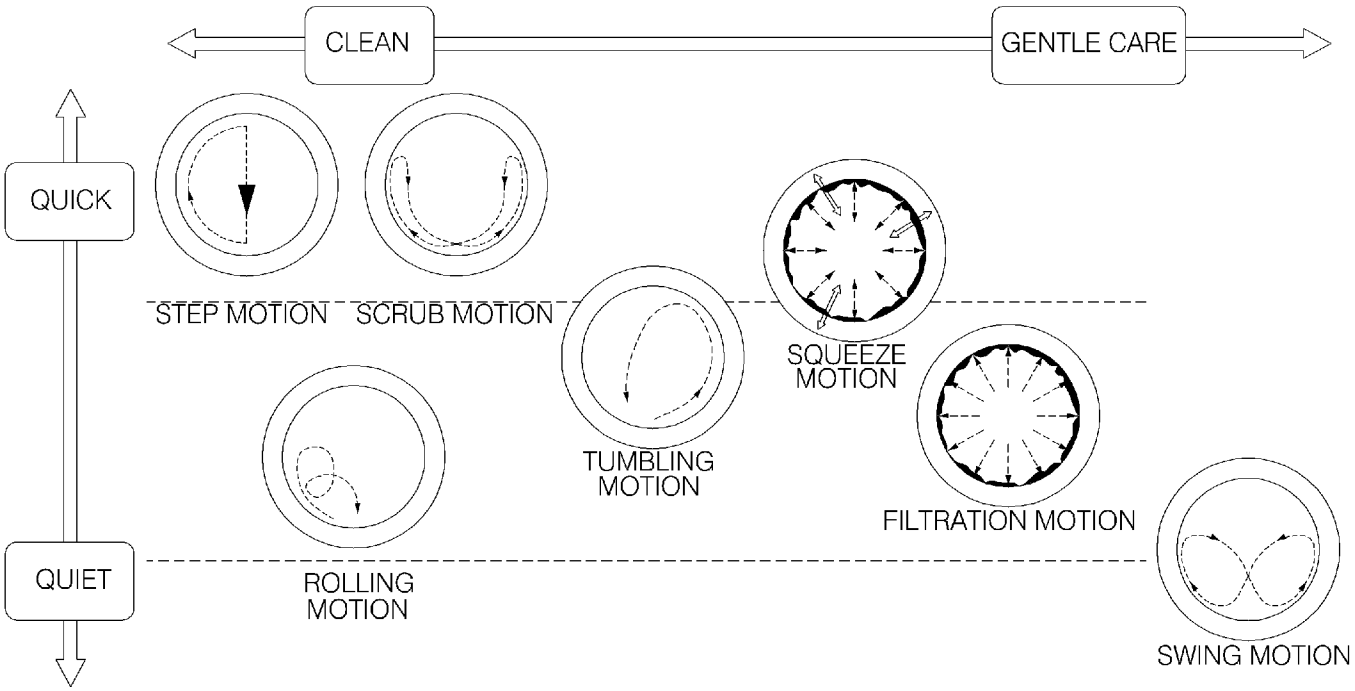
FIG. 8 is a graph for comparison in washing performance and a degree of vibration between drum driving motions.

FIG. 8 is a graph for comparison in washing performance and a degree of vibration between drum driving motions. In FIG. 8, a horizontal axis represents washing performance, and contaminants included in laundry may be more easily separated toward a leftward direction of the horizontal axis. The vertical axis represents a degree of vibration and a noise level, and the degree of vibration increases toward an upward direction of the vertical axis while a time required to wash the same laundry decreasing toward the upward direction of the vertical axis.

The step motion and the scrub motion are motions appropriate for a washing course selected when laundry is contaminated a lot and when a washing time needs to be reduced. In addition, the step motion and the scrub motion are motions that results in a high degree of vibration and a high noise level. Therefore, the step motion and the scrub motion are not preferable motions for a washing course selected when laundry is sensitive clothes or when noise and vibration need to be minimized.

The rolling motion is a motion characterized by excellent washing performance, a low degree of vibration, a minimized possibility of damage to laundry, and a low motor load. Thus, the rolling motion is applicable to every washing course, and especially appropriate in dissolving detergent and soaking laundry in the initial washing stage. However, the rolling motion generates a low degree of vibration but takes a longer time to wash laundry to a particular level, compared to the tumbling motion.

The tumbling motion has a low washing performance than that of the scrub motion, but a degree of vibration thereof is between a degree of vibration of the scrub motion and a degree of vibration of the rolling motion. The tumbling motion is applicable to every washing course, and especially useful for a step of dispersing laundry.

The squeeze motion has a washing performance similar to that of the tumbling motion, and a degree of vibration thereof is higher than that of the tumbling motion. In the squeeze motion, wash water penetrates laundry and is discharged to the outside of the drum 40 in the procedure in which the laundry repeats stuck to and being separated from the inner circumferential surface of the drum 40, and therefore, the squeeze motion is useful for a step of rinsing or a step of providing wash water to the laundry.

The filtration motion has a washing performance lower than that of the squeeze motion and a noise level similar to that of the rolling motion. In the filtration motion, wash water penetrates laundry and is discharged to the tub 31 while the laundry is stuck to the inner circumferential surface of the drum 40, and therefore, the filtration motion is useful for a step of soaking the laundry or a step of providing wash water to the laundry in the initial washing stage.

The swing motion is a motion having the lowest degree of vibration and the lowest washing performance. Therefore, the swing motion is a motion useful for a low-noise or low-vibration washing course and for gentle care which means washing sensitive clothes.

Figure 9:
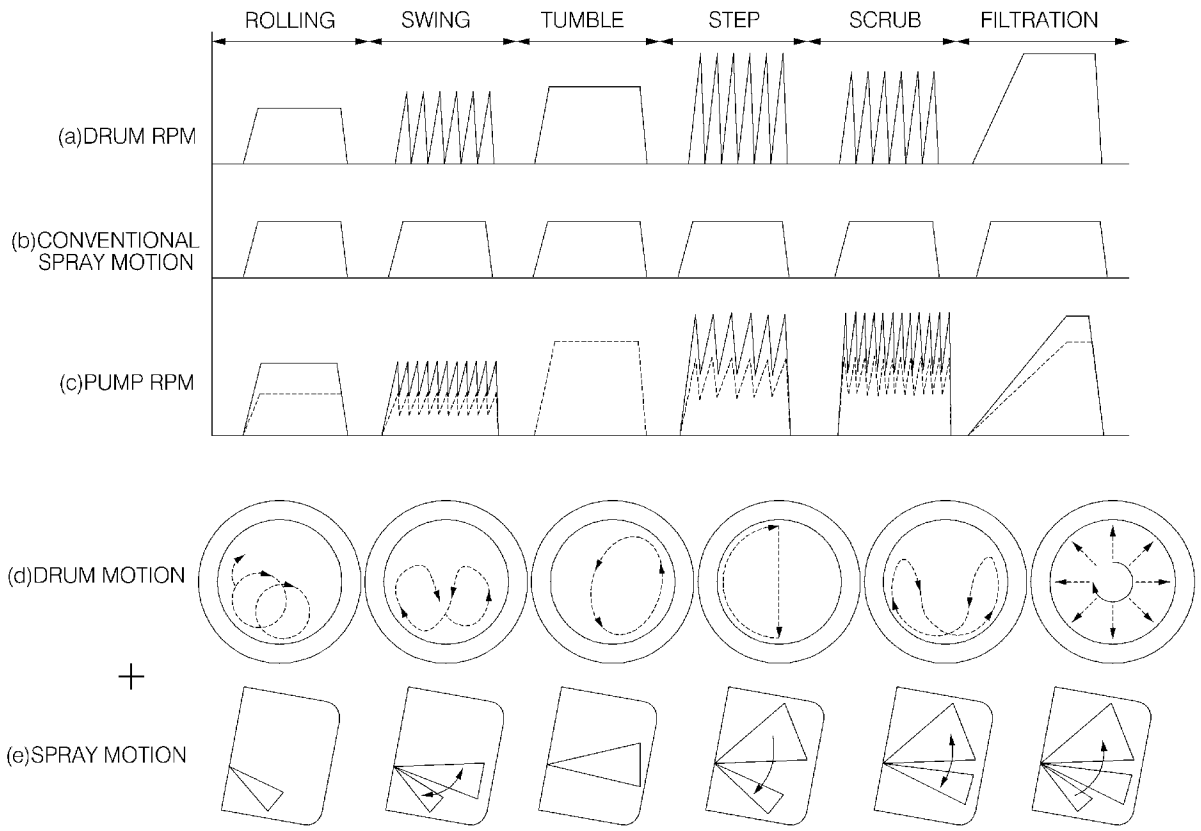
FIG. 9 is a diagram for explanation of a spray motion in each drum driving motion of the present invention compared with an existing motion.

FIG. 9 is a diagram for explanation of a spray motion in each drum driving motion of the present invention compared with an existing motion. In FIG. 9, (a) is a graph illustrating a rotation speed of the drum 40 or the washing motor 93 in each drum driving motion, (b) is a graph illustrating a rotation speed of a circulation pump motor in each drum driving motion in an existing washing machine having a constant speed pump, (c) is a graph illustrating a rotation speed of the circulation pump motor 92 in each drum driving motion in a washing machine according to an embodiment of the present invention, and (e) illustrates a jet form (hereinafter, referred to as a "spray motion") through the at least one nozzle 83*a* or 83*b* in each drum driving motion in a washing machine according to an embodiment of the present invention.

Referring to FIG. 9, since the existing washing machine is not capable of varying a speed of the circulation pump motor, the existing washing machine has no choice except rotating the circulation pump motor at a constant speed all the time even though a drum driving motions changes. Thus, the existing washing machine is not able to effectively respond to movement of laundry caused according to a type of a drum driving motion, by using a water stream sprayed through a nozzle, and there are difficulties in managing power consumption, washing performance, and soaking laundry. The present invention aims to solve these problems by appropriately controlling the rotation speed of the circulation pump motor 92 according to a drum driving motion and furthermore taking a laundry load into consideration in this course.

In particular, in the case of a drum driving motion in which laundry is lifted while stuck to an inner circumferential surface 42 of the drum 40 and, when reaching a predetermined height, separated away from the inner circumferential surface 42 due to braking of the drum 40 and thereby falls therefrom (hereinafter, referred to as "falling trigger motion by braking": for example, the swing motion, the step motion, or the scrub motion), a rotation speed of the circulation pump motor 92 may be controlled to vary within a predetermined speed range. That is, the circulation pump motor 92 may be controlled to repeat an operation of accelerating to the upper limit of the speed range and decelerating to the lower limit of the speed range.

A range in which the rotation speed of the circulation pump motor 92 is varied while the falling trigger motion by braking is in execution may be set according to a laundry load.

In a section in which the circulation pump motor 92 is controlled to rotate at a constant speed in the rolling motion, the tumbling motion, and the filtration motion, the rotation speed of the circulation pump motor 92 may be set according to a laundry load.

Meanwhile, referring to (c) of FIG. 9, RPM of the circulation pump motor 92 may be controlled in a different manner in the rolling motion, the swing motion, the step motion, the scrub motion, and the filtration motion. In the drawing, RPM of the circulation pump motor 92 in response to a large laundry load is indicated with a solid line, and RPM of the circulation pump motor 92 in response to a small laundry load is indicated with a dotted line. In the case of the tumbling motion, RPM of the circulation pump motor 92 may be controlled in a manner which is identical regardless of a laundry load.

In each drum driving motion illustrated in FIG. 9, operation of the washing motor 93 and operation of the circulation pump motor 92 are linked to each other. Hereinafter, a method for controlling the washing motor 92 and the circulation pump motor 92 will be described with reference to FIG. 10. In FIG. 9, A1 to A6 illustrates steps of controlling the washing motor 93, and B1 to B6 illustrates steps of controlling the circulation pump motor 92.

While a washing machine operates, if a preset drum driving motion starts, the processor 91 controls the washing motor 93 and the circulation pump motor 92 according to a method set for each drum driving motion.

Specifically, the processor 91 initiates driving of the washing motor 93 (A1), and accelerates the washing motor 93 (A2). There may be provided a sensor for sensing a rotation angle of the drum 40, and, if the rotation angle of the drum 40 sensed by the sensor reaches a predetermined value e (hereinafter, referred to as a "motion angle") (A3), the processor 91 may perform control to decelerate the washing motor 93 (A4).

In the rolling motion, the tumbling motion, and the filtration motion, the drum 40 may consecutively rotate once or more, and, in this case, the motion angle θ has a value of 360 degrees or more.

On the contrary, in a falling trigger motion by braking, such as the swing motion, the step motion, and the scrub motion, the motion angle θ may be set to an appropriate value within a range of 180 degrees according to characteristics of each corresponding drum driving motion. For example, the motion angle θ may be 30 to 45 degrees in the swing motion, 146 to 161 degrees in the step motion, and 139 to 150 degrees in the scrub motion.

When the drum 40 is decelerated to stop, the drum driving motion is completed once, and then the drum driving motion is performed again (A5). Steps A2 to A5 are repeatedly performed until the number of times the drum driving motion is performed reaches a preset number of times, and, when the number of times the drum driving motion is performed reaches the preset number of times, operation of the washing motor 93 is stopped (A6).

Meanwhile, when driving of the washing motor 93 is initiated in the step A1, the processor 91 applies a start signal SG1 to the circulation pump motor 92 and driving of the circulation pump motor 92 is initiated in response to the start signal SG1 (B1). Then, based on motion information (that is, information on the currently implementing drum driving motion), the processor 91 accelerates the circulation pump motor 92 according to a setting that is set for each drum driving motion (B2).

Meanwhile, in the step S3, when the rotation angle of the drum 40 reaches the motion angle θ, the processor 91 applies an angle control completion signal SG2 to the circulation pump motor 92.

In the case of the falling trigger motion by braking, in response to the angle control completion signal SG2, the rotation speed stops from being accelerated (or the circulation pump motor 92 is braked) after the rotation speed reaches an upper limit value Pr(V, H) set for each drum driving motion, and then the rotation speed is decelerated (B4, B5) according to a setting that is set for each drum driving motion.

Then, when the driving of the washing motor 92 is initiated again in the step A5, the processor 91 applies a restart signal SG3 to the circulation pump motor 92. In response to the restart signal SG3, the circulation pump motor 92 stops decelerating the rotation speed when the rotation speed reaches a lower limit value Pr(V, L) set for each drum driving motion (B5), and repeats the steps B2 to B5.

Meanwhile, in the case of the rolling motion, the tumbling motion, or the filtration motion, at a time when the angle control completion signal SG2 is applied to the circulation pump motor 92, the circulation pump motor 92 is rotating with maintaining a rotation speed set for each corresponding drum driving motion. Thus, in the above-mentioned motions, the circulation pump motor 92 is decelerated (B4) in response to the angle control completion signal SG2.

Meanwhile, in any drum driving motion, when the washing motor 93 stops in the step A6, the processor 91 applies a stop signal SG4 to the circulation pump motor 92, and the circulation pump motor 92 stops in response to the stop signal SG4.

Figure 11:
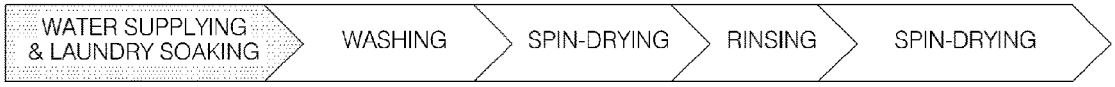
FIG. 11 illustrates the entire washing order applicable to a washing machine of the preset invention.

As illustrated in FIG. 11, a washing machine may be configured to implement a water supplying/laundry soaking cycle, a washing cycle, a spin-drying cycle, a rinsing cycle, and a spin-drying cycle in a sequence. The water supplying/laundry soaking cycle is a cycle for soaking laundry with supplying water with detergent.

The washing cycle is a cycle for removing contaminants from laundry by rotating the drum 40 according to a preset algorithm, and the rolling motion or the tumbling motion may be implemented during the washing cycle.

The spin-drying cycle is a cycle for removing moisture from laundry by rotating the drum 40 at a high speed. While the drum 40 rotates, the drain pump 33 may operate.

The rinsing cycle is a cycle for removing detergent from laundry. During the rinsing cycle, water is supplied and the rolling motion or the tumbling motion may be performed. After the rinsing cycle, the spin-drying cycle may be implemented again.

Hereinafter, a method for controlling the washing motor 93 and the circulation pump motor 92 in each drum driving motion will be described in more detail.

Figure 12:
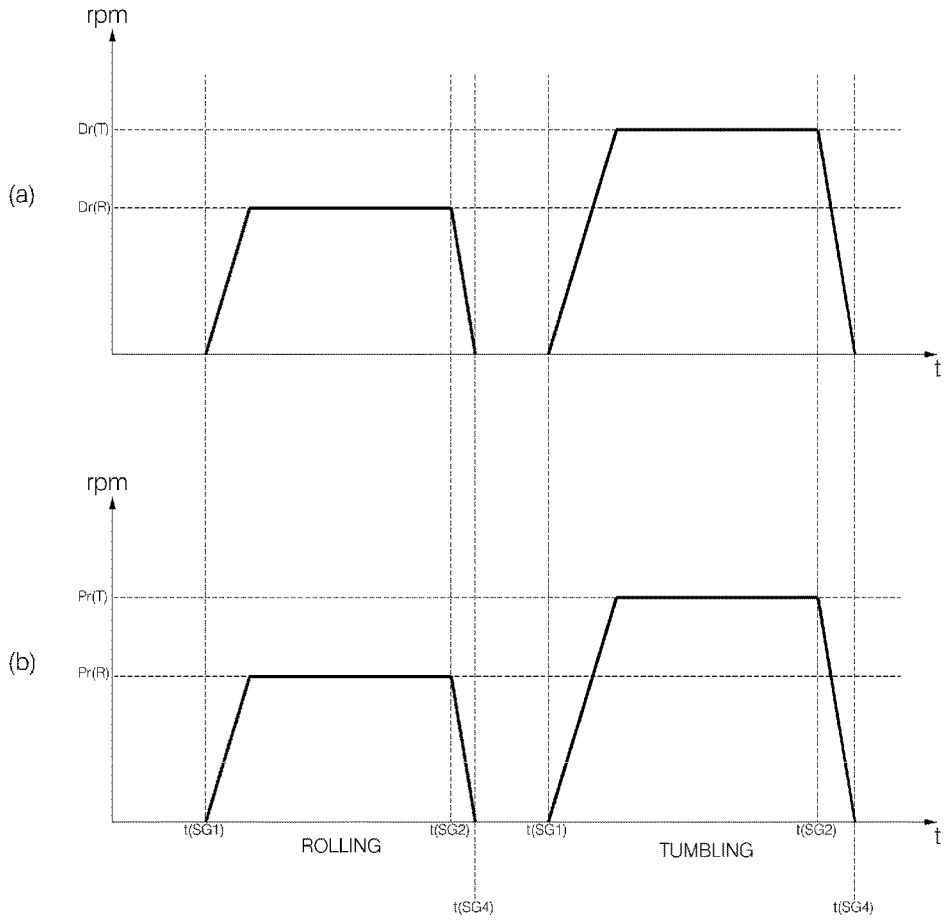
FIG. 12 are graphs illustrating a speed (a) of a washing motor and a speed (b) of a circulation pump motor in a rolling motion and a tumbling motion.
Figure 16:
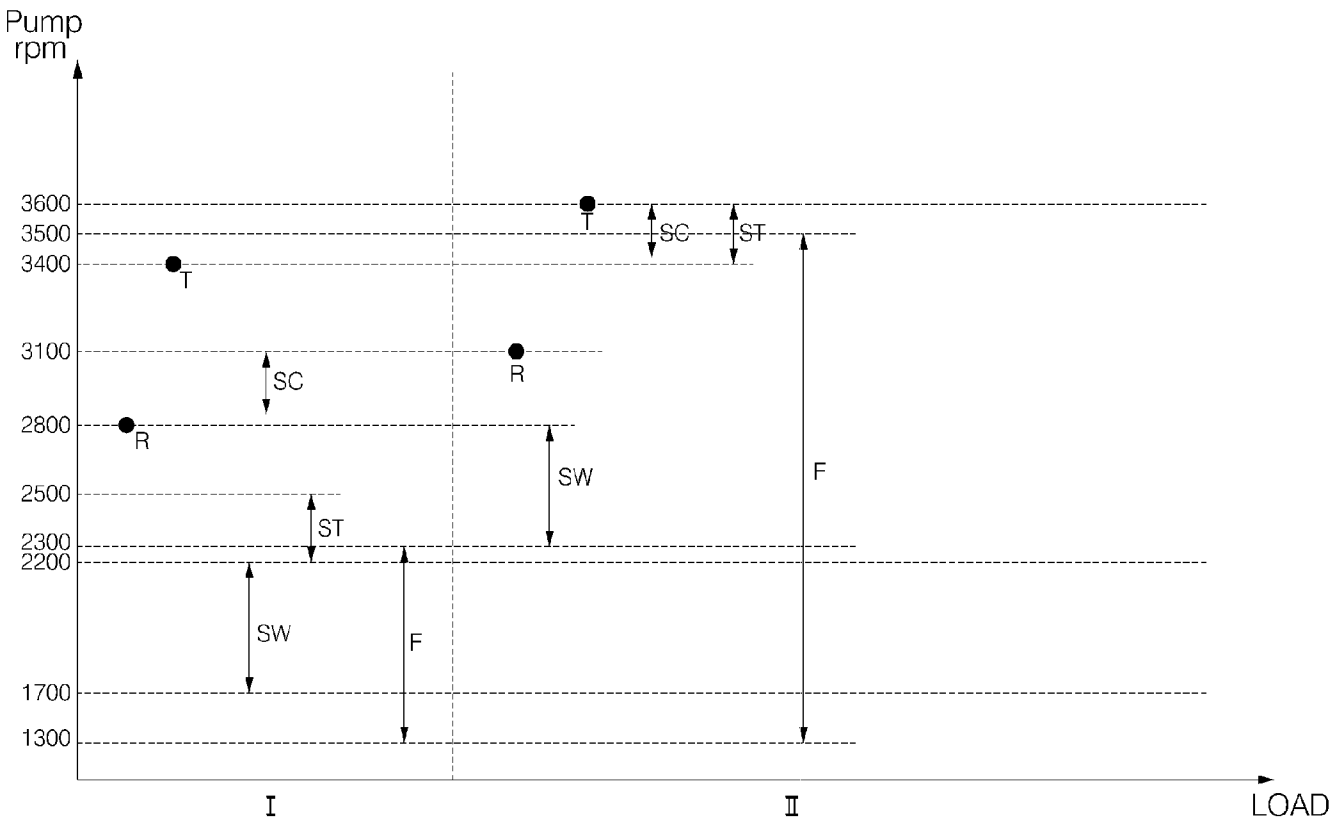
FIG. 16 is a graph for comparing a speed of a circulation pump motor in each drum driving motion between when a laundry load falls into a first laundry load range I and when the laundry load falls into a second laundry road range II.

FIG. 12 shows a graph of a speed (a) of a washing motor in the rolling motion and the tumbling motion, and a graph of a speed (b) of a circulation pump motor in the rolling motion and the tumbling motion. FIG. 16 is a graph of comparison between when a laundry load falls within a first laundry load range I and when a laundry load falls within a second laundry load range II.

The washing machine may perform a first step of rotating the drum 40 in one direction such that laundry on the inner circumferential surface of the drum 40 is lifted to a point corresponding to a rotation angle about less than 90 degrees of the drum 40 and falls therefrom, and a second step of rotating the drum 40 in one direction such that laundry on the inner circumferential surface of the drum 40 is lifted higher than a point corresponding to a rotation angle less than 130 degrees of the drum 40 and then falls therefrom. The second step may be performed after the first step, but aspects of the present invention are not limited thereto, and the second step may be performed prior to the first step.

The number of times of rotation of the circulation pump 36 during the first step may be controlled to a preset first rotation value, and the number of times of rotation of the circulation pump 36 during the second step may be controlled to a second rotation value higher than the first rotation value. Here, the first rotation value and the second rotation value are values in a period in which the circulation pump 36 rotates with maintaining a constant speed.

A driving motion of the drum 40 (that is, a drum driving motion) in the first step may correspond to the rolling motion. A drum driving motion in the second step may be the rolling motion or the tumbling motion, and may be preferably the tumbling motion. Hereinafter, an example of performing the rolling motion in the first step and the tumbling motion in the second step is described.

Referring to FIGS. 12 to 16, the rolling motion and the tumbling motion are performed with water contained in the tub 31 so that a water stream can be sprayed through the at least one nozzle 83*a* or 83*b*. Referring to FIG. 12, in the rolling motion, the drum 40 is accelerated to a rotation speed Dr(R) and rotates with maintaining the rotation speed Dr(R) for a predetermined time. The rotation speed Dr(R) is preferably 37 to 40 rpm but not necessarily limited thereto.

During the rolling motion, a rotation speed of the circulation pump motor 92 is controlled to a preset rotation speed Pr(R). In FIG. 12, t(SG1) denotes a time when a star signal SG1 (see FIG. 10) is generated, t(SG2) denotes a time when an angle control completion signal SG2 (see FIG. 10) is generated, and t(SG4) is a time when a stop signal SG4 (see FIG. 10) is generated. Hereinafter, the same indications are used in other examples.

The rotation speed Pr(R) may be set according to a laundry load. Before implementing a drum driving motion, the processor 91 may rotate the washing motor 93 and sense a laundry load while rotating the washing motor 93. The laundry load may be determined based on the principle that rotation inertia of the drum 40 changes according to a load of laundry accommodated in the drum 40. For example, the laundry load may be calculated by measuring a time taken to reach a preset target speed, by measuring an acceleration gradient of the washing motor 93, by measuring a time taken to stop the washing motor 93 in the course of braking the washing motor 93, by measuring a deceleration gradient, or by measuring a counter-electromotive force. Aspects of the present invention are not limited thereto, and various methods of calculating a laundry load have been well-known in washing machine-related fields and thus these well-known methods may be applicable. Hereinafter, although not described, it is assumed that a step of sensing a laundry load is performed before performing each drum driving motion.

The processor 91 may set the rotation speed Pr(R) according to a laundry load range into which a sensed laundry load falls. For example, a laundry load may be divided into first to ninth categories. In the case where the laundry load range is divided into a small load (or the first laundry load range I; see, FIG. 16) and a large load (or the second laundry load range II; see, FIG. 16), if the sensed laundry load corresponds to the first to fourth categories, it may be classified into a small load, and, if the sensed laundry load corresponds to the fifth to ninth categories, it may be classified as a large load. However, aspects of the present invention are not limited thereto, and a laundry load range may be divided for each category.

In the embodiment, when a laundry load is large, the rotation is set higher than when the laundry load is small. For example, if the laundry load is small, the rotation speed Pr(R) may be set to 2800 rpm, and, if the laundry load is large, the rotation speed Pr(R) may be set to 3100 rpm. In particular, when the laundry load is small, most of the laundry is moving in the front portion of the drum 40 and thus a water stream sprayed from the at least one nozzle 83*a* or 83*b* does not necessarily reach the rear surface 41 of the drum 40. (less than 2800 rpm; See FIG. 6).

On the contrary, when the laundry load is large, laundry is loaded up to the center of the drum 40 and thus a water stream sprayed from the at least one nozzle 83*a* or 83*b* needs to reach a height higher than the center of the drum 40. Therefore, it is preferable that the water stream reaches the first quadrant Q1 (see FIG. 5) and the second quadrant Q2 (see FIG. 5), and, to this end, a rotation speed of the circulation pump motor 92 is set to 3000 rpm or higher, preferably 3100 rpm.

In the tumbling motion, the washing motor 93 and the circulation pump motor 92 are controlled in a manner similar to a manner in the rolling motion. However, with respect to the same laundry load, the rotation speed Dr(R) of the washing motor in the tumbling motion is set higher than in the rolling motion, and the rotation speed Pr(T) of the circulation pump motor 92 in the tumbling motion is also set higher than in the rolling motion. Meanwhile, the rotation speed Dr(T) of the washing motor 93 is preferably 46 rpm but not necessarily limited thereto.

Meanwhile, in the tumbling motion, it is important to apply a stronger mechanical force to laundry than in the rolling motion, and thus, a water stream sprayed through the at least one nozzle 83*a* or 83*b* needs to have sufficient pressure regardless of a laundry load. Thus, in the tumbling motion, the circulation pump motor 92 may rotate at a constant speed of a predetermined value between 3400 rpm and 3600 rpm, regardless of a laundry load. However, aspects of the present invention are not limited thereto, and, when the laundry load is large, the rotation speed Pr(T) may be set higher than when the laundry load is small. For example, the rotation speed Pr(T) may be set to 3400 rpm when the laundry load is small, and 3600 rpm when the laundry load is large.

Steps of controlling the circulation pump 36 while implementing the above-described rolling and tumbling motions are appropriate for the washing cycle and/or the rinsing cycle among a series of cycles shown in FIG. 11.

Figure 13:
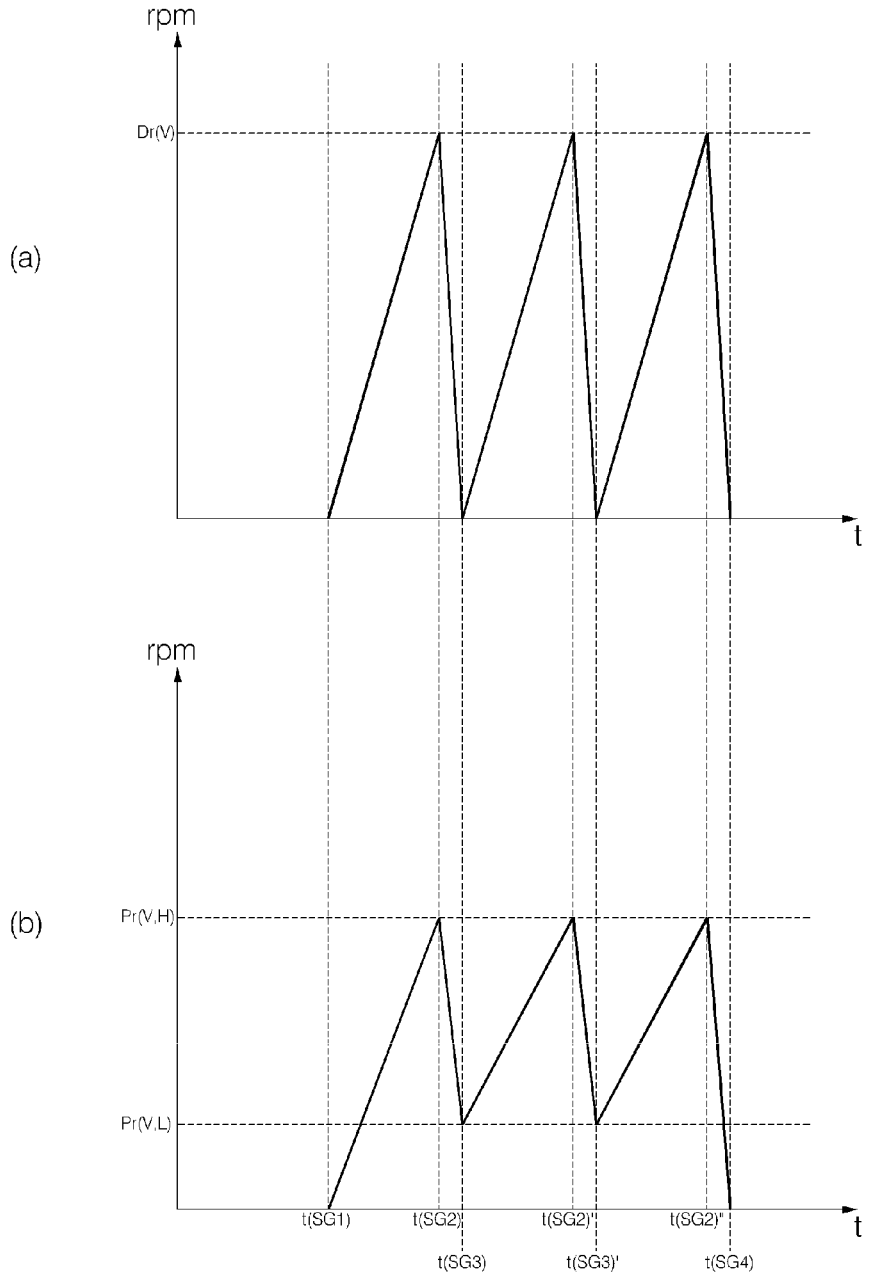
FIG. 13 is a graph for explanation of how a washing motor and a circulation pump motor operate in a swing motion, a scrub motion, and a step motion according to an embodiment of the present invention.

FIG. 13 is a graph for explanation of how a washing motor and a circulation pump motor operate in a swing motion, a scrub motion, and a step motion according to an embodiment of the present invention.

Referring to FIGS. 13 and 16, in a falling trigger motion by braking, the processor 91 performs control such that a rotation speed of the circulation pump motor 92 changes while the drum 40 rotates.

While water is contained in the tub 13, a step of rotating the drum 40 at a speed Dr(V), at which laundry on the inner circumferential surface of the drum 40 is lifted owing to the centrifugal force without falling from the inner circumferential surface of the drum 40, and then braking the drum 40 to make the laundry to fall from the inner circumferential surface of the drum 40 is performed (hereinafter, referred to as a falling trigger step).

In this case, a step of increasing a rotation speed of the circulation pump 36 while the laundry is lifted by the rotation of the drum 40, and decreasing the rotation speed of the circulation pump 36 in response to braking of the drum 40 is performed (hereinafter, referred to as a varying spraying step).

The falling trigger step is repeated with changing the rotation direction of the drum 40, and the varying spraying step is repeated in response thereto.

While the varying spraying step is performed, the level of water in the tub 31 should be at least a degree in which a water stream can be sprayed through the at least one nozzle 83*a* or 83*b* upon operation of the circulation pump 36. A drum driving motion in the falling trigger step is a falling trigger motion. The processor 91 may control the washing motor 93 such that the drum 40 rotates at a speed, at which laundry is lifted without falling from the inner circumferential surface 42 of the drum 40, and then the drum 40 is braked to make the laundry fall from the inner circumferential surface 42. That is, in the falling trigger motion by braking, the washing motor 93 increases up to a preset rotation seed Dr(V) and decreases to stop, and, in the course of accelerating the washing motor 93 to the rotation speed Dr(V), the laundry remains stuck to the inner circumferential surface 42.

The rotation speed Dr(V) may be set differently for each drum driving motion. The maximum laundry lifting height increases in order of the swing motion, the scrub motion, and the step motion, and thus, the magnitude of the centrifugal force should increase in order of the swing motion, the scrub motion, and the step motion. Therefore, the rotation speed Dr(V) may be set to increase in order of the swing motion, the scrub motion, and the step motion.

However, the maximum laundry lifting height in the falling trigger motion by braking is also determined by a rotation angle (or, a motion angle θ) by which the drum 40 is braked, and thus, even in the case where an identical rotation speed Dr(V) is set for all of the swing motion, the scrub motion, and the step motion, if a motion angle θ is set differently for each of the motions, the maximum laundry lifting height (or a height at which laundry starts falling) may differ. In either case, it is preferable that the motion angle θ is set to increase in order of the swing motion, the scrub motion, and the step motion. Within a range in which the above premise is satisfied, the motion angle θ may be set to be, for example, 30 to 45 degrees for the swing motion, 139 to 150 degrees for the scrub motion, and 146 to 161 degrees for the step motion.

Meanwhile, during the falling trigger motion by braking, the processor 91 may increase the rotation speed of the circulation motor 92 while laundry is lifted (or while the washing motor 93 is accelerated).

During the falling trigger motion by braking, the processor may decelerate the rotation speed of the circulating pump motor 92 while laundry falls (or when the washing motor 93 is braked, thereby being decelerated).

That is, the processor 91 may control the circulation pump motor 92 such that the circulation pump motor 92 is accelerated in response to acceleration of the washing motor 93 and decelerated in response to braking of the washing motor 93.

The rotation speed of the circulation pump motor 92 may be varied within a rotation speed range set for each drum driving motion. In FIG. 13, the upper limit value of the rotation speed range is indicated as the highest rotation speed Pr(V, H), and the lower limit value thereof is indicated as the lowest rotation speed Pr (V, L).

Hereinafter, the highest rotation speed of the circulation pump motor 92 as the upper limit of a preset rotation speed range. The highest rotation speed of the circulation pump motor 92 does not refer to the maximum speed at which the circulation pump 92 is capable of rotating.

Before implementing a drum driving motion, the processor 91 may rotate the washing motor 93 and sense a laundry load while rotating the washing motor 93. A method for sensing the laundry load may be implemented as described above in regard with the rolling/tumbling motion, or any other method may be used.

The rotation speed range may be set according to a laundry load. That is, the processor 91 may set the highest rotation speed Pr(V, H) and the lowest rotation speed Pr(V, L) according to the laundry load. In each drum driving motion, the rotation speed range may be set to be higher as the laundry load is larger.

For example, in the case of a scrub motion SC, when a sensed laundry load corresponds to a small load (or the first laundry load range I; see FIG. 16), the rotation speed of the circulation pump motor 92 may be varied between the lowest rotation speed Pr (V, L) of 2800 rpm and the highest rotation speed Pr(V, H) of 3100 rpm. In addition, when a sensed laundry load corresponds to a large load (or the second laundry load range II; see FIG. 16), the rotation speed of the circulation pump motor 92 may be varied between the lowest rotation speed Pr(V, L) of 3400 rpm and the highest rotation speed Pr(V, H) of 3600 rpm.

In the case of a step motion ST, when a sensed laundry load corresponds to a small load (or the first laundry load range I; see FIG. 16), the rotation speed of the circulation pump motor 92 may be varied between the lowest rotation speed Pr (V, L) of 2200 rpm and the highest rotation speed Pr(V, H) of 2500 rpm. In addition, when a sensed laundry load is corresponds to a large load (or the second laundry load range II; see FIG. 16), the rotation speed of the circulation pump motor 92 may be varied between the lowest rotation speed Pr(V, L) of 3400 rpm and the highest rotation speed Pr(V, H) of 3600 rpm.

Meanwhile, even in the case of a swing motion SW, a range in which the rotation speed of the circulation pump motor 92 is varied according to a laundry load may be set in a manner similar to that of the scrub motion SC or the step motion ST.

In the case of the swing motion SW, when a sensed laundry load corresponds to a small load (or the first laundry load range I; see FIG. 16), the rotation speed of the circulation pump motor 92 may be varied between the lowest rotation speed Pr (V, L) of 1700 rpm and the highest rotation speed Pr(V, H) of 2200 rpm. In addition, when a sensed laundry load is a large load (or the second laundry load range II; see FIG. 16), the rotation speed of the circulation pump motor 92 may be varied between the lowest rotation speed Pr(V, L) of 2300 rpm and the highest rotation speed Pr(V, H) of 2800 rpm.

In this case, it is preferable that the rotation speed of the circulation pump motor 92 is set within a range which does not allow a water stream sprayed from the at least one nozzle 83*a* or 83*b* to reach the rear surface 41 of the drum 40 (for example, 2200 to 2800 rpm; see FIG. 6).

However, since the height at which laundry falls in the swing motion is smaller than in the scrub motion or the step motion, a predetermined rotation speed range of the circulation pump motor 92 may be set regardless of a laundry load. For example, both in the case of a large laundry load and in the case of a small laundry load, the rotation speed of the circulation pump motor 92 may be varied between the lowest rotation speed Pr(V, L) of 2200 rpm and the highest rotation speed Pr(V, H) of 2800 rpm.

Hereinafter, operations of a washing motor and a circulation pump motor in a swing motion, a scrub motion, and a step motion according to an embodiment of the present invention will be described in more detail with reference to FIGS. 10, 13, and 16.

Figure 10:
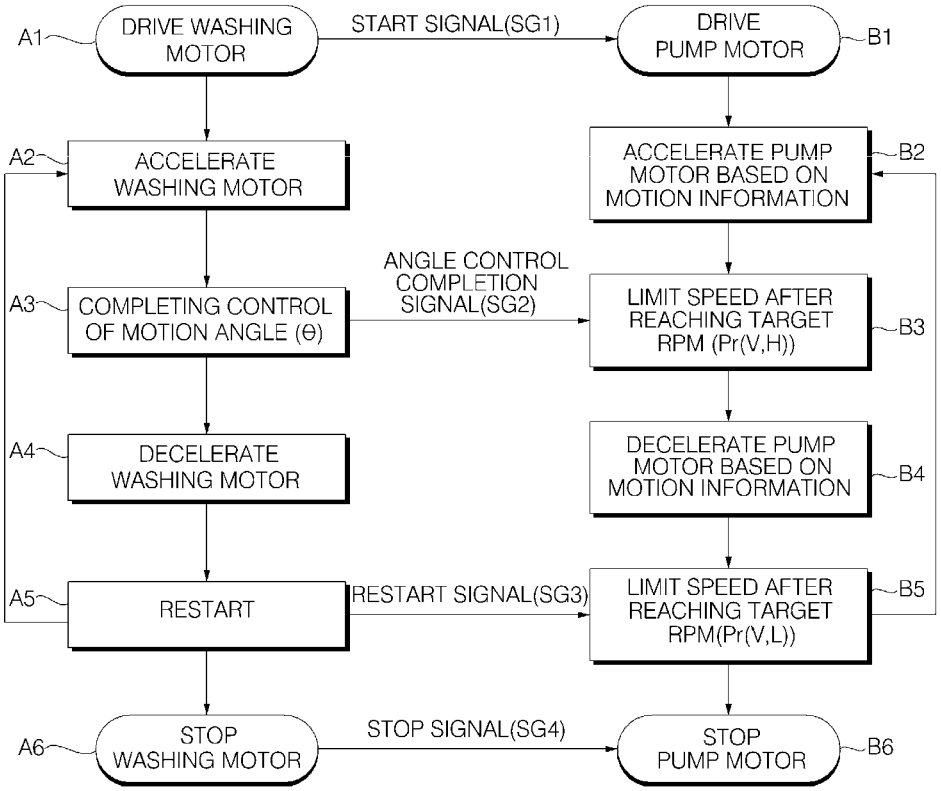
FIG. 10 is a flowchart illustrating a method for controlling a washing motor and a circulation pump motor in drum driving motions.

Referring to FIGS. 10 and 13, the processor 91 may accelerate the washing motor 93 to a preset highest rotation speed Dr(V) (A2).

When the washing motor 93 is driven (A1), the processor 91 may generate a start signal SG1. In response to the start signal SG1, the circulation pump motor 92 may start operating.

When the circulation pump motor 92 is driven (B1), the processor 91 may accelerate the circulation pump motor 92 based on motion information (B2).

The processor 91 may accelerate the circulation pump motor up to the highest rotation speed Pr(V, H). When the circulation pump motor 92 reaches the target RPM (Pr(V, H)), the processor 91 may stop accelerating the circulation pump motor 92, limiting the speed thereof (B3).

The processor 91 may rotate the washing motor 93 up to by a preset motion angle θ. The processor 91 may control the washing motor 93 such that a time when the washing motor 93 reaches the highest rotation speed Dr(V) and a time when the washing motor 93 is rotated by the motion angle θ corresponds to each other.

When the washing motor 93 rotates by up to the motion angle θ (A3), the processor 91 may generate an angle control completion signal SG2. In accordance with the angle control completion signal SG2, the circulation pump motor 92 may be decelerated (B4).

Referring to FIG. 13, the processor 91 may control the washing motor 91 and the circulation pump motor 92 such that a time when the washing motor 93 reaches the highest rotation speed Dr(V) and a time when the circulation pump motor 92 reaches the highest rotation speed Pr(V, H) correspond to each other.

However, time delay, such as a time required to perform processing by the processor 91 or a time required to transmit a signal, may occur between a time t(SG2) when the angle control completion signal SG2 is generated as the washing motor 93 is controlled to the motion angle θ (or s the washing motor 93 reaches the highest rotation speed Dr(V)) (A3), and a time when deceleration of the circulation pump motor 92 starts in response to the generated angle control completion signal SG2. Therefore, as illustrated in FIG. 13, in order to decelerate the circulation pump motor 92 immediately at the time when the washing motor 93 reaches the highest rotation speed Dr(V), it is preferable that the processor 91 anticipates an angle control completion time (that is, a time when washing motor 93 reaches the highest rotation speed Dr(V)) and generates the angle control completion signal SG2 a little bit earlier than the angle control completion time.

After completely controlling the washing motor 93 to the motion angle θ (or after controlling the washing motor 93 to reach the highest rotation speed Dr(V)) (A3), the processor 91 may decelerate (or brake) the washing motor 93 (A4).

In a drum driving motion (for example, the step motion, the scrub motion, and the swing motion) in which the washing motor is set to repeat being accelerated and decelerated multiple times, the processor 91 may return to the step A2 of accelerating the washing motor 93 and repeats the steps A2 to A4 (A5, A2, A3, A4). At this point, the processor 91 may generate a restart signal SG3.

The processor 91 may decelerate the circulation pump motor up to the lowest rotation speed Pr(V, L). When the circulation pump motor 92 reaches the target RPM (Pr(V, L)), the processor 91 may stop decelerating the circulation pump motor 92 (B5).

In response to the restart signal SG3, deceleration of the circulation pump motor 92 may stop and the steps B2 to B4 may be performed again (B5).

Referring to FIG. 13, acceleration of the circulation pump motor 92 may start in accordance with the restart signal SG3.

Meanwhile, referring to FIG. 13, the processor 91 may control the washing motor 93 and the circulation pump motor 92 such that a time t(SG3) when the washing motor 93 is completely braked (a time when the drum 40 stops) and a time t(SG3) when the circulation pump motor 92 reaches the lowest rotation speed Pr(V, L) coincide with each other.

However, delay time, such as a time required to perform processing by the processor 91 or a time required to transmit a signal, may occur between the time t(SG3) when the restart signal SG3 is generated and the time when the circulation pump motor 92 starts to be accelerated. Therefore, as illustrated in FIG. 13, in order to accelerate the circulation pump motor 92 immediately at a time when the washing motor 93 stops, it is preferable that the processor 91 anticipates a stopping time when the washing motor 93 stops, and generates the restart signal SG3 a little bit earlier than the stopping time.

When it is determined based on motion information that a set operation is completed, the processor 91 may perform control such that the washing motor 93 stops (A6).

When the washing motor 93 stops, the processor 91 may generate a stop signal SG4. In accordance with the stop signal SG4, the circulation pump motor 92 may stop (A6).

In response to the stop signal SG4, the circulation pump motor 92 may start to be decelerated. Alternatively, the processor 91 may perform control such that the circulation pump motor 92 stops at a time coinciding with a stopping time of the washing motor 93 (or such that the circulation pump motor 92 and the washing motor 93 stop at the same time).

Referring to FIG. 13, the processor 91 may perform control such that the circulation pump motor 92 stops at the same time with the washing motor 93.

However, a delay time, such as a time required to perform processing by the processor 91 or a time required to transmit a signal, may occur between a time t(SG4) when the processor 91 generates the stop signal SG4 upon stopping of the washing motor 93 and a time when the circulation pump motor 92 stops based on the generated stop signal SG4. Therefore, as illustrated in FIG. 13, in order to make the circulation pump motor 92 and the washing motor 93 stop at the same time, it is preferable that the processor 91 anticipates a stopping time t(SG4) of the washing motor 93 and generates the stop signal SG4 a little bit earlier than the stopping time t(SG4).

Hereinafter, with reference to FIG. 13, a control method according to an embodiment of the present invention will be described mainly about difference from FIG. 13.

Referring to FIG. 13, a time when the circulation pump motor 92 reaches the highest rotation speed Pr(V, H) may fall into a range from a time t(SG2) when the washing motor 93 reaches the highest rotation speed Dr(V) to a time t(SG3) when the washing motor 93 is decelerated to thereby reach the lowest rotation speed (for example, 0 rpm).

The processor 91 may perform control such that the circulation pump motor 92 is decelerated after a first time period t1 since the time t(SG2) when the washing motor 93 is braked (or decelerated). The first time period t1 refers to a time difference between the time t(SG2) when the washing motor is braked (or decelerated) and a time t(H) when the circulation pump motor 92 is decelerated, and the first time period t1 may be a preset value.

Alternatively, the processor 91 may perform control such that the circulation pump motor 92 reaches the highest rotation speed Pr(V, H) after the first time period t1 since the time when the washing motor 93 reaches the highest rotation speed Dr(V).

In this case, the first time period t1 may refer to a time difference between the time t(SG2) when the washing motor 93 reaches the highest rotation speed Dr(V) and the time t(H) when the circulation pump motor 92 reaches the highest rotation speed Pr(V, H).

The processor 91 may generates the angle control completion signal SG2 after completely controlling the washing motor 93 to the motion angle θ (A3), and then perform control such that the circulation pump motor 92 is decelerated when the circulation pump motor 92 reaches the target RPM Pr(V, H).

Meanwhile, if the circulation pump motor 92 has yet to reach the highest rotation speed Pr(V, H) at the time t(SG2) when the angle control completion signal SG2 is generated, the processor 91 may accelerate the circulation pump motor 92 up to the highest rotation speed Pr(V, H). In this case, the first time period t1 refers to a time period required for the circulation pump motor 92 to reach the highest rotation speed Pr(V, H) from the time t(SG2) when the angle control completion signal SG2 is generated.

Meanwhile, the processor 91 may accelerate the circulation pump motor 92 at a first rotation acceleration from the time t(SG1) to the time t(SG2), and accelerate the circulation pump motor 92 at a second rotation acceleration from the time t(SG2) to a time when the circulation pump motor 92 reaches the highest rotation speed Pr(V, H). The second rotation acceleration may be smaller than the first rotation acceleration.

Meanwhile, referring to FIG. 13, when it is determined that the circulation pump motor 92 reaches the highest rotation speed Pr(V, H) before the first time period t1 elapses since the time t(SG2) when the washing motor 93 is braked, the processor 91 may perform control such that the circulation pump motor 92 maintains the high rotation speed Pr(V, H). The circulation pump motor 92 may rotate with maintaining the highest rotation speed Pr(V, H) from the time t(SG2) to the time t(H) when the first time period t1 elapses.

The processor 91 may perform control such that the circulation pump motor 92 starts to be decelerated at the time t(H).

Referring to FIG. 13, the processor 91 may perform control such that the circulation pump motor 92 reaches the lowest rotation speed Pr(V, L) after a second time period t2 since the time t(SG3) when the restart signal SG3 is generated in response to stopping of the washing motor 93. The second time period t2 may be equal to or shorter than the first time period t1.

Although not illustrated, the processor 91 may control the washing motor 93 and the circulation pump motor 92 such that the circulation pump motor 92 reaches the lowest rotation speed Pr(V, L) at a time when the washing motor 93 stops. In this case, the second time period t2 is 0.

As illustrated in FIG. 13, the washing motor 93/the circulation pump motor 92 may repeat being accelerated and decelerated a preset number of times. In this case, a rotation direction of the washing motor 93 may change upon acceleration.

That is, in FIG. 13, while the washing motor 93 is accelerated, laundry is lifted in contact with the drum 40 and falls from the inner circumferential surface 42 of the drum 40 at the time t(SG2) when the washing motor 93 is braked. At this point, the circulation pump motor 92 rotates the highest rotation speed Pr(V, H) and jets water with the highest intensity through the at least one nozzle 83*a* or 83*b*, thereby enabled to apply a physical impact to the falling laundry.

Although not illustrated, until the first time period t1 elapses since the time t(SG2) when the washing motor 93 is braked, the processor 91 may perform control such that the circulation pump motor 92 is decelerated at a third deceleration gradient. Furthermore, when the first time period t1 elapses, the processor 91 may perform control such that the circulation pump motor 92 is decelerated at a fourth acceleration gradient greater than the third acceleration gradient. That is, the processor 91 may gradually decelerate the circulation pump 92 when the washing motor 93 starts to be braked, and, if the first time period t1 elapses since the time when the washing motor 93 starts to be braked, the processor 91 may decelerate the circulation pump motor 92 sharply.

In this case, while laundry falls due to braking of the washing motor 93, the circulation pump motor 92 is decelerated at the third acceleration gradient but still in operation. In particular, considering that the third acceleration gradient is smaller than the fourth acceleration gradient, a water stream sprayed from the at least one nozzle 83*a* or 83*b* in the middle of deceleration of the circulation pump motor 92 at the third acceleration gradient may apply a considerable impact to the laundry falling from the inner circumferential surface of the drum 40, thereby improving washing performance.

Figure 14:
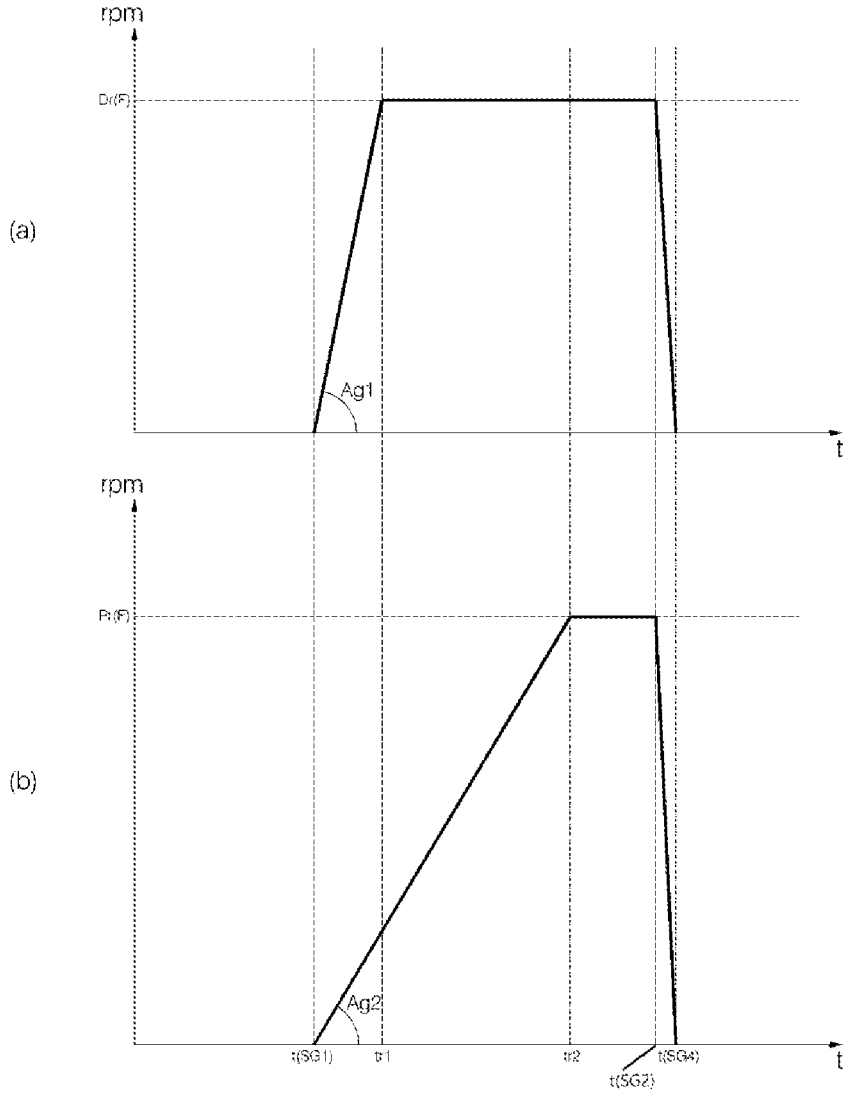
FIG. 14 illustrates a change in the number of times of rotation (a) of a drum (a) and a change in the number of times of rotations of a pump (b) according to another embodiment of the present invention.
Figure 15:
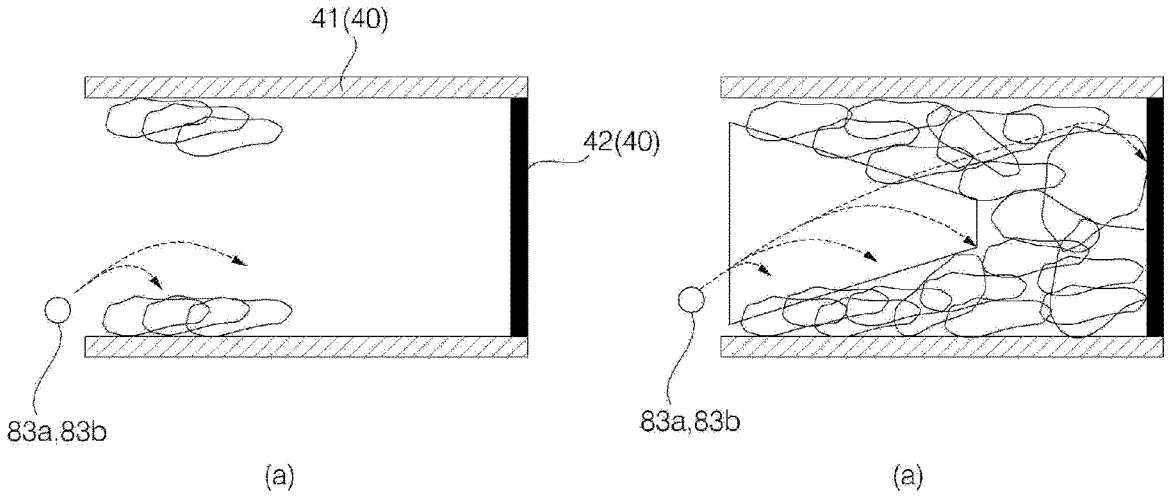
FIG. 15 illustrates the form of arrangement of laundry in a drum in the middle of a filtration motion.

FIG. 14 illustrates a change in the number of times of rotation (a) of a drum (a) and a change in the number of times of rotations of a pump (b) according to an embodiment of the present invention. FIG. 15 illustrates the form of arrangement of laundry in a drum in the middle of a filtration motion. In FIG. 15, (a) illustrates the case where a small amount of laundry is loaded in the drum, and (b) illustrates the case where a large amount of laundry is loaded in the drum.

A method for controlling a washing machine according to an embodiment of the present invention includes a step of rotating the drum 40 in one direction such that laundry to prevent the drum 40 from falling from the inner circumferential surface of the drum 40. This step corresponds to the above-described filtration motion.

Referring to FIGS. 14, 15, and 16, the processor 91 may perform control such that a rotation speed Pr(F) of the circulation pump motor 92 increases while the drum 40 rotates in one direction (preferably, one or more times) during the filtration motion. If a rotation speed of the drum 40 starts to increase during the filtration motion, the centrifugal force applied to laundry increases as well and a laundry item in the most vicinity to the inner circumferential surface of the drum becomes sticking thereto sequentially. That is, in the course in which the rotation speed of the drum 40 increases to the preset rotation speed Dr(F) in the filtration motion, a sufficient centrifugal force is not provided in the initial stage to laundry positioned at the center of the drum 40, thereby causing the laundry to move. Afterward, if the rotation speed of the drum 40 increases sufficiently, the position of most of the laundry (preferably, all of the laundry) in the drum 40 is fixed relative to the drum 40.

In particular, if the amount of laundry in the drum 40 is equal to or smaller than a predetermined threshold, the laundry is usually gathered around the entrance of the drum 40 in the filtration motion (see (a) of FIG. 15). In this case, it is preferable to decrease the rotation speed of the circulation pump 36 such that circulating water sprayed from the at least one nozzle 83*a* or 83*b* falls in the front portion of the drum 40.

On the contrary, if the amount of laundry in the drum 40 is greater than the predetermined threshold, an empty space in the drum 40 surrounded by the laundry extends toward the rear from the entrance of the drum 40 while the rotation speed of the drum 40 increases, thereby resulting in the form shown in (b) of FIG. 15.

Controlling the rotation speed of the circulation pump 36 to increase in the filtration motion is conceived from the above-described extension of the empty space in the drum 40, which occurs in the filtration motion. That is, while the empty space extends toward the rear of the drum 40, spraying pressure of the at least one nozzle 83*a* or 83*b* is controlled to increase in accordance therewith, thereby allowing water stream to reach a region deep inside the drum 40.

In the filtration motion, the processor 91 accelerates the washing motor 93 to the preset rotation speed Dr(F), and, when the washing motor 93 reaches the preset rotation speed Dr(F), the processor 91 performs control to maintain the preset rotation speed Dr(F) for a preset time period. The rotation speed Dr(F) is determined within a range of speeds at which laundry rotates while stuck to the inner circumferential surface of the drum 40, and the rotation speed Dr(F) may vary according to a laundry load and may be set to between 80 rpm and 108 rpm, approximately.

In the filtration motion, the highest rotation speed Pr(F) of the circulation pump motor 92 may be set differently according to a laundry load. That is, the processor 91 may set the highest rotation speed Pr(F) of the circulation pump motor according to a sensed laundry load. The highest rotation speed Pr(F) of the circulation pump motor 92 may be set such that the highest rotation speed Pr(Fs) in response to the sensed laundry load corresponding to a small load (or the first laundry load range I; see FIG. 16) is higher than the highest rotation speed Pr(Fm) in response to the sensed laundry road corresponding to a large load (or the second laundry load range II; see FIG. 16).

In this case, the rotation speed of the circulation pump 36 may be set to increase in correspondence with a time t1. When the rotation of the drum 40 is accelerated. That is, the time of when to accelerate the rotation of the drum 40 and the time of when to increase the rotation speed of the circulation pump 36 are linked (or synchronized).

In (b) of FIG. 14, a dotted-line graph illustrates a change in the rotation speed of the circulation pump 36 in the case where a laundry load is equal to or greater than a reference threshold, and a solid-line graph illustrates a change in the rotation speed of the circulation pump 36 in the case where a laundry load is smaller than the reference threshold. As illustrated in the drawing, the drum 40 may be braked when the rotation speed of the circulation pump 36 reaches (t=t(SG2)) to the preset highest rotation speed Pr(Fm) or Pr(Fs).

The method for controlling a washing machine according to the embodiments of the present invention may further include a step of sensing an amount of laundry in the drum 40 (hereinafter, referred to as a "laundry load"). There are various well-known methods for calculating a laundry load. For example, the drum 40 may be accelerated with laundry loaded therein, and a laundry load may be determined based on a time period taken until a rotation speed of the drum 40 reaches a preset rotation speed. However, aspects of the present invention are not limited thereto, and the laundry load may be calculated using any other well-known method.

Controlling the circulation pump 36 while implementing the filtration motion, as described above, is appropriate for the water supplying/laundry soaking cycle or the rinsing cycle among the series of cycles shown in FIG. 11.

Figure 17:
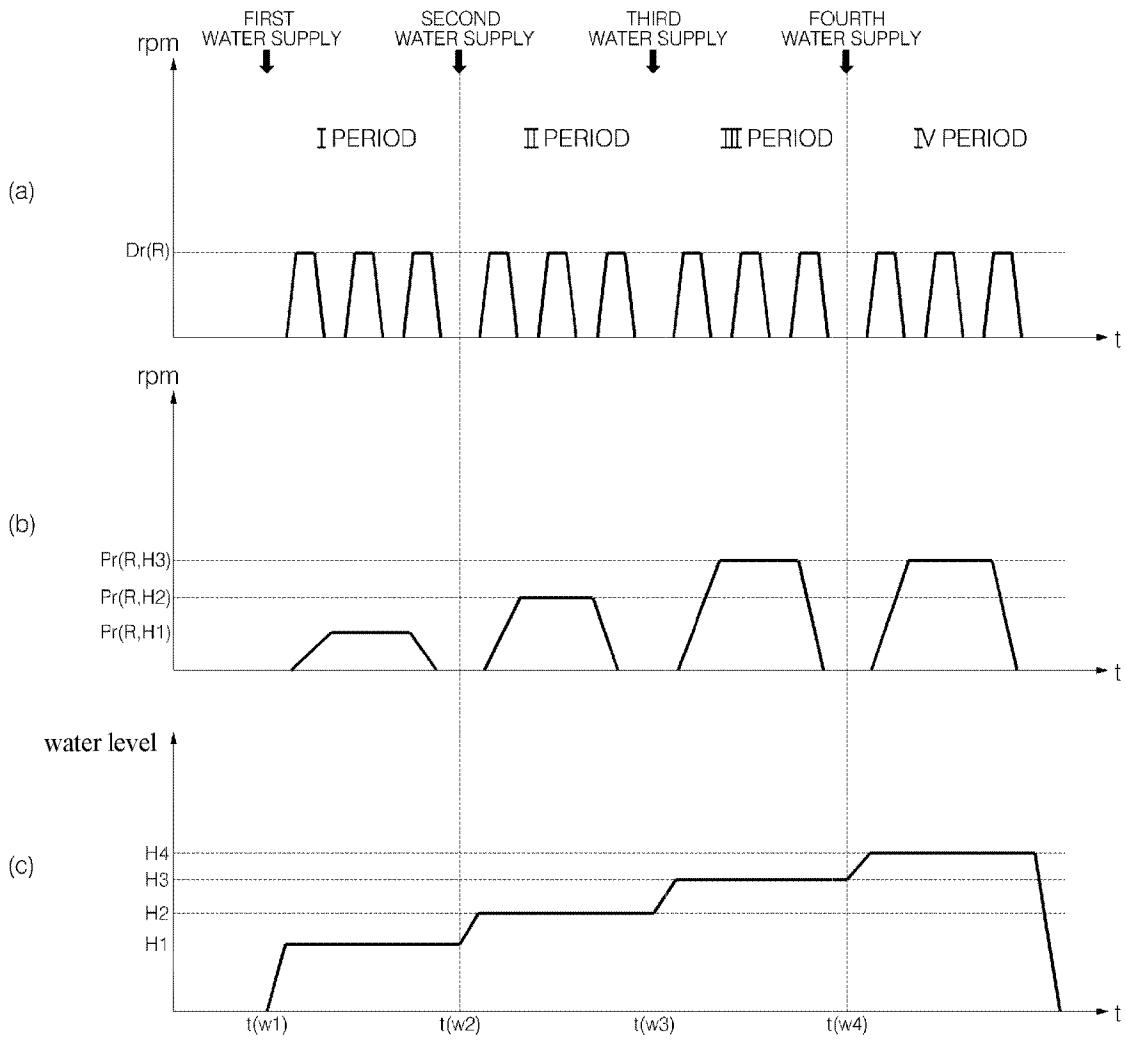
FIG. 17 is a diagram for explanation of a method for controlling a washing machine according to an embodiment of the present invention.

FIG. 17 is a diagram for explanation of a method for controlling a washing machine according to an embodiment of the present invention. The method includes a step of rotating the drum 40 such that laundry in the drum is lifted to a predetermined height and falls therefrom while the drum 40 is filled with water (for example, a falling trigger motion by braking, a rolling motion, or a tumbling motion), and controlling the circulation pump 36 such that water is sprayed through at least one nozzle 83*a* or 83*b* while the drum 40 rotates.

Such rotation of the drum 40 may be implemented by accelerating the washing motor 96 to a predetermined speed Dr(R) and then decelerating the washing motor 96, and operation and stopping of the washing motor 36 may be repeated at a predetermined time interval, as illustrated in FIG. 17.

Specifically, the processor 91 may control the washing motor 93 such that laundry in the drum 40 is lifted by a first angle in a rotation direction of the drum 40 while stuck on the inner circumferential surface 42 of the drum and falls therefrom.

The first angle may be less than 90 degrees. In this case, the processor 91 may perform a rolling motion to rotate the drum in one direction such that the laundry stuck to the inner circumferential surface 42 of the drum 40 falls from a predetermined point corresponding to a rotation angle about less than 90 degrees of the drum 40.

In another example, the first angle may be 90 degrees to 130 degrees. The processor 91 may perform a tumbling motion to rotate the drum 40 in one direction such that laundry stuck to the inner circumferential surface 42 of the drum falls from a predetermined point corresponding to a rotation angle of about 90 degrees to 130 degrees in a rotation direction of the drum 40.

In another example, a falling trigger motion by braking may be performed, and, in this case, the processor 91 may brake the washing motor 93 such that the drum 40 rotates at a speed, at which the laundry is lifted without falling from the inner circumferential surface 42 of the drum, and then the laundry falls from the circumferential surface 42 of the drum 40.

When the falling trigger motion by braking is performed, the processor 91 may set the first angle differently depending on a drum driving motion. The first angle may be set to be 30 to 45 degrees for the swing motion, 139 to 150 degrees for the scrub motion, and 146 to 161 degrees for the step motion.

Hereinafter, a procedure in which the processor 91 controls the washing motor 93 such that laundry in the drum 40 is lifted by the first angle in the rotation direction of the drum 40 while stuck to the inner circumferential surface 42 of the drum and then falls therefrom will be described as an example of the above-described rolling motion.

While the drum 40 rotates, an additional water supply is performed, increasing the level of water in the drum 40, and the rotation speed of the circulation pump 36 increases in response to the increase in the water level. Upon the additional water supply, the water supply valve 94 may be opened. The additional water supply may be performed multiple times, and acceleration of the circulation pump 36 may be performed multiple times in response to the multiple-times additional water supply. According to an embodiment, when the water supply valve 94 is opened upon the additional water supply, water may be supplied through the direct water nozzle 57.

Specifically, when the level of water in the drum 40 corresponds to a first water level (e.g., H1), the circulation pump 36 rotates a first rotation speed (e.g., Pr(R, H1) that is set in correspondence with the first water level, and, when the level of water in the drum 40 increases to a second level (e.g., H2) upon a water supply, the circulation pump 36 rotates at a second rotation speed (e.g., Pr(R, H2) in correspondence with the second water level.

Here, the second rotation speed may be higher than the first rotation speed. By increasing the rotation speed of the circulation pump 36 in response to an increase in the level of water in the drum 40, a flow rate and/or water pressure sprayed from the at least one nozzle 83*a* or 83*b*.

A step of sensing an amount of laundry in the drum 40 (hereinafter, referred to as a "laundry load") may be performed, and the second water level may be set according to a sensed laundry load. If the laundry load is large, a large amount of water may be absorbed by the laundry and a greater flow rate needs to be sprayed from the at least one nozzle 83*a* or 83*b* to soak the laundry, and therefore, it is preferable that the second water level is set to be higher as the laundry load is larger.

Rotating the circulating pump 36 at the second rotation speed may be performed after the level of water in the drum 40 reaches the second water level. In the case of increasing the rotation speed of the circulation pump 36 before the level of water in the drum 40 increases, it is preferable to increase the rotation speed of the circulation pump 36 after the water level increases sufficiently.

However, aspects of the present invention are not limited thereto, and the rotation speed of the circulation pump 36 or the circulation pump motor 92 may be changed (or increased) at a time when water is supplied to the drum 40. In this case, at a time when the water is supplied to the drum 40, the rotation speed of the circulation pump 36 may increase by an amount of increase in speed that is set based on an amount of water supplied.

Hereinafter, referring to FIG. 17, all procedures of the method for controlling a washing machine according to an embodiment of the present invention will be described.

The processor 91 may control the water supply valve 94 to supply detergent-dissolved wash water into the tub 31 such that the level of water in the drum reaches the first water level H1 (first water supply).

The processor 91 may control the water supply valve 94 such that the level of water in the drum 40 reaches the second water level H2 higher than the first water level H1.

The processor 91 may control the water supply valve 94 such that the level of water in the drum 40 reaches a third water level H3 higher than the second water level H2 (third water supply).

The processor 91 may control the water supply valve 94 such that the level of water in the drum 40 reaches a fourth water level H4 higher than the third water level H3.

The processor 91 may control the circulation pump motor 92 to rotate at a I-period rotation speed Pr(R, H1) in the I period where the level of water in the drum corresponds to the first water level H1. The a I-period rotation speed Pr(R, H1) may be 1800 to 2200 rpm (preferably 2000 rpm).

The processor 91 may control the circulation pump motor 92 at a II-period rotation speed Pr(R, H2) faster than the I-period rotation speed Pr(R, H1) in the II period where the level of water in the drum 40 corresponds to the second water level H2. The II-period rotation speed Pr(R, H2) may be set to be 2250 to 2750 rpm (preferably 2500 rpm).

The processor 91 may control the circulation pump motor 92 to rotate at a III-period rotation speed Pr(r, H3) faster than the II-period rotation speed Pr(R, H2) in the III period where the level of water in the drum 40 correspond to a third water level H3. The III-period rotation speed Pr(R, H3) may be set to be 2520 to 3080 rpm (preferably, 2800 rpm).

The processor 91 may control the circulation pump motor 92 to rotate at the III-period rotation speed Pr(R, H3), which is the highest rotation speed, in a IV period where the level of water in the drum 40 corresponds to a fourth water level H4.

The processor 91 may set the water level H4 according to a sensed laundry load.

The processor 91 may set at least one of the first water level H1, the second water level H2, or the third water level H3 based on the set fourth water level H4. That is, when the fourth water level H4 is set, the processor 91 may calculate the first water level H1, the second water level H2, and the third water level H3 based on a preset formula.

Alternatively, the processor 91 may set at least one of the first water level H1, the second water level H2, or the third water level H3 according to a sensed laundry load.

In doing so, the level of water in the drum is set to be higher as the laundry load is larger, and therefore, the laundry may be soaked enough and washing may be performed effectively.

The processor 91 may perform the first water supply t=t(w1), and, after a preset time period, perform the second water supply t=t(w2). A time interval between the first water supply and the second water supply may be a preset value.

The processor 91 may perform the second water supply t=t(w2), and, after a preset time period, perform the third water supply t=t(w3). A time interval between the second water supply and the third water supply may be a preset value.

The processor 91 may set the time interval between the first water supply and the second water supply and the time interval between the second water supply and the third water supply to be different.

For example, the processor 91 may set a water supply time such that the time interval tgap=t(w3)−t(w2) between the second water supply and the third water supply is greater than the time interval tgap=t(w2)−t(w1) between the first water supply and the second water supply. It is because a washing time can extend longer as the level of wash water in the drum 40 increases higher.

Likewise, the processor 91 may set a time interval between the third water supply and the fourth water supply to be different from a time interval between the first water supply and the second water supply or a time interval between the second water supply and the third water supply.

In doing so, in each of the I period, the II period, and the III period, washing may be performed in consideration of the level of wash water.

The processor 91 may change a rotation speed of the circulation pump motor 92 at a time when each of the first water supply, the second water supply, and the third water supply is performed. At a time when the fourth water supply is performed, the processor 91 may maintain the rotation speed of the circulation pump motor 92 in the assumption that the circulation pump motor 92 is rotating at the highest rotation speed.

The processor 91 may set an amount of increase in the rotation speed of the pump motor 92 based on an amount of water supplied in each of the first water supply, the second water supply, and the third water supply. According to the set amount of increase, the processor 91 may accelerate the pump motor 92 at a time when each of the second water supply, and the third water supply is performed.

However, the rotation speed of the circulation pump motor 92 is not allowed to exceed the highest rotation speed that is set according to a sensed laundry load. According to a laundry load sensed in the laundry sensing step, the processor 91 may set the highest rotation speed of the pump motor 92.

The processor 91 may accelerate the pump motor 92 in phases until the circulation pump motor 92 reaches to the set highest rotation speed.

After the circulation pump motor 92 reaches to the set highest rotation speed, the processor 91 may perform control such that the circulation pump motor 92 maintains the highest rotation speed despite a change in the level of water in the drum 40.

Referring to FIG. 17, the level of water in the drum 40 may increase to the fourth water level H4 by the fourth water supply.

In the IV period where the level of water in the drum 40 corresponds to the fourth water level H4, the processor 91 may control the rotation speed of the circulation pump motor 92 to be the highest rotation speed Pr(R, H3). That is, even when the level of water in the drum constantly increases by an additional water supply, the processor 91 may control the circulation pump motor 92 not to exceed the highest rotation speed.

In the last water supply in the washing step, that is, the fourth water supply in this embodiment, the processor 91 may control the water supply valve 94 such that detergent dissolved wash water is introduced into the tub 31.

Meanwhile, when the water level decreases to the preset water levels H1 to H4 or lower in each of the I to IV periods, the processor 91 may perform additional water supply even in the middle of each period.

For example, when the washing motor 93 stops, the level of water in the drum 40 is sensed using a water level sensor, and, when it is determined, based on the sensed information, the level of water in the drum 40 is different by a preset value or more from a preset water level, the processor 91 may control the water supply valve 94 so as to additionally supply water into the drum 40.

In each of the I to IV periods, the processor 91 may control the circulation motor 92 in response to acceleration or deceleration of the washing motor 93.

Alternatively, in each of the I to IV periods, the processor 91 may control the circulation pump motor 92 to rotate at a set speed for a predetermined time period. In this case, the circulation pump motor 92 may not be necessarily controlled in response to acceleration or deceleration of the washing motor 93.

Using the method for controlling a washing machine according to this embodiment, intensity of water sprayed through the at least one nozzle 83*a* or 83*b* may be adjusted, thereby enhancing washing performance.

In addition, washing is performed with highly detergent concentrated wash water while the level of water in the drum 40 is maintained low, and then washing operation is performed with increasing the water level, thereby enhancing washing performance.

In the case where the rotation speed of the circulation pump motor 92 is constantly maintained to be a high speed, the level of water in the drum is lowered and an additional water supply is required. In this case, a more amount of wash water for washing may be needed, or it may be difficult to perform washing with highly detergent concentrated wash water. According to this embodiment, as the rotation speed of the pump motor 92 changes depending on the level of water in the drum 40, it is possible to reduce an amount of water used in washing laundry and perform washing with highly detergent concentrated wash water in an initial washing stage.

In addition, when the level of water in the drum 40 increases sufficiently by an additional water supply, pressure of water sprayed through a nozzle may be increased, thereby enhancing washing effect using a physical impact by the water pressure.

In addition, an amount of water additionally supplied, a rotation speed of the circulation pump motor, a time interval between water supplies, and the like may be changed according to the level of wash water, thereby performing a washing process efficiently and reducing an overall time to perform the washing process.

The present invention as described above may be implemented as code that can be written on a computer-readable medium in which a program is recorded and thus read by a computer. The computer-readable medium includes all kinds of recording devices in which data is stored in a computer-readable manner. Examples of the computer-readable recording medium may include a hard disk drive (HDD), a solid state disk (SSD), a silicon disk drive (SDD), a read only memory (ROM), a random access memory (RAM), a compact disk read only memory (CD-ROM), a magnetic tape, a floppy disc, and an optical data storage device. In addition, the computer-readable medium may be implemented as a carrier wave (e.g., data transmission over the Internet). In addition, the computer may include a processor or a controller.

What is claimed is:

1. A washing machine comprising:

a casing having a front surface that defines a case opening;

a tub disposed in the casing and configured to receive water, the tub having a tub opening that is accessible through the case opening;

a drum that is rotatably disposed in the tub and configured to receive laundry through the case opening and the tub opening;

at least one nozzle configured to spray water into the drum;

a washing motor configured to rotate the drum;

a circulation pump configured to circulate water within the washing machine, the circulation pump comprising a circulation pump motor;

a water level sensor configured to sense a water level in the drum based on the washing motor being stopped;

at least one processor; and at least one computer memory that is operably connectable to the at least one processor and that has stored thereon instructions which, when executed, cause the at least one processor to perform operations comprising:

performing a first water supply operation for supplying water to the drum to a first water level, rotating the drum and controlling the circulation pump to rotate at a first rotation speed based on the water level sensor sensing the first water level, after rotating the circulation pump at the first rotation speed, stopping the washing motor and the circulation pump motor, performing a second water supply operation for supplying water to the drum to increase the water level in the drum to a second water level after the first water supply operation, rotating the drum and controlling the circulation pump to rotate at a second rotation speed based on the water level sensor sensing the second water level, after controlling the circulation pump to rotate at the second rotation speed, stopping rotation of the washing motor and the circulation pump motor, performing a third water supply operation for supplying water to the drum to increase the water level in the drum to a third water level after the second water supply operation, rotating the drum and controlling the circulation pump to rotate at a highest rotation speed set based on the water level sensor sensing the third water level, after controlling the circulation pump to rotate at the highest rotation speed, stopping rotation of the washing motor and the circulation pump motor, performing a fourth water supply operation for supplying water to the drum to increase the water level in the drum to a fourth water level after the third water supply operation, and rotating the drum and controlling the circulation pump to rotate at the highest rotation speed based on the water level sensor sensing the fourth water level.

2. The washing machine of claim 1, wherein the second rotation speed is greater than the first rotation speed.

3. The washing machine of claim 1, wherein the operations further comprise:

sensing an amount of laundry in the drum; and setting the second water level according to a sensed amount of laundry in the drum, and wherein supplying water to the drum comprises supplying water to the drum to increase the water level in the drum to the second water level that is set according to the sensed amount of laundry.

4. The washing machine of claim 1, wherein rotating the drum comprises repeatedly alternating between rotating the drum and stopping rotation of the drum with a predetermined time interval in a state in which the circulation pump is operated.

5. The washing machine of claim 1, wherein rotating the drum is performed to cause the laundry in the drum to be raised to a predetermined height with respect to a bottom of the drum and to fall from the predetermined height into the drum in a state in which the drum is supplied with water, and wherein the operations further comprise:

controlling the washing motor to cause laundry in the drum to be raised to a first position at an inner circumferential surface of the drum corresponding to a first angle with respect a reference position in a state in which the laundry stays in contact with the inner circumferential surface of the drum and to fall from the first position at the inner circumferential surface of the drum into the drum.

6. The washing machine of claim 1, wherein controlling the circulation pump comprises increasing or decreasing a rotation speed of the circulation pump motor based on an amount of water supplied to the drum.

7. The washing machine of claim 1, further comprising:

a water supply valve connected to a water source; and a direct water nozzle configured to spray, to the drum, water supplied through the water supply valve, wherein supplying water to the drum comprises opening the water supply valve to supply water through the direct water nozzle to increase the water level in the drum to the second water level.

8. The washing machine of claim 1, wherein the at least one processor is configured to set at least one of the first water level or the second water level based on a sensed amount of laundry in the drum.

9. The washing machine of claim 1, wherein the fourth water level is higher than the third water level, and wherein the at least one processor is configured to calculate at least one of the first water level, the second water level, or the third water level based on applying a value corresponding to the fourth water level to a preset formula.

10. The washing machine of claim 1, wherein a time interval between the second water supply operation and the third water supply operation is set to be greater than a time interval between the first water supply operation and the second water supply operation.

11. The washing machine of claim 10, wherein a time interval between the third water supply operation and the fourth water supply operation is set to be different from the time interval between the first water supply operation and the second water supply operation, or the time interval between the second water supply operation and the third water supply operation.

12. The washing machine of claim 1, wherein the operations further comprise:

sensing an amount of laundry in the drum;

setting the first water level and the second water level according to the sensed amount of laundry in the drum, the first water level being less than the second water level; and increasing the first water level based on an increase of the sensed amount of laundry.

* * * * *